US007215082B2

(12) United States Patent
Arakawa et al.

(10) Patent No.: US 7,215,082 B2
(45) Date of Patent: May 8, 2007

(54) ELECTRODELESS SELF-BALLASTED FLUORESCENT LAMP AND ELECTRODELESS DISCHARGE LAMP OPERATING APPARATUS

(75) Inventors: Takeshi Arakawa, Kyoto (JP); Akira Hochi, Nara (JP); Tomohiro Sawa, Osaka (JP); Mitsuharu Kawasaki, Osaka (JP)

(73) Assignee: Matsushita Electric Industrial Co, Ltd., Osaka (JP)

( * ) Notice: Subject to any disclaimer, the term of this patent is extended or adjusted under 35 U.S.C. 154(b) by 21 days.

(21) Appl. No.: 10/490,924

(22) PCT Filed: Jun. 27, 2003

(86) PCT No.: PCT/JP03/08252

§ 371 (c)(1),
(2), (4) Date: Mar. 26, 2004

(87) PCT Pub. No.: WO2004/006288

PCT Pub. Date: Jan. 15, 2004

(65) Prior Publication Data

US 2005/0012458 A1 Jan. 20, 2005

(30) Foreign Application Priority Data

Jul. 2, 2002 (JP) ..... 2002-193354

(51) Int. Cl.
*H01J 61/35* (2006.01)

(52) U.S. Cl. ..... 313/635; 313/489; 313/492; 313/628; 313/573; 313/634; 313/160

(58) Field of Classification Search ..... 313/489, 313/492, 628, 635, 629, 573, 634, 160
See application file for complete search history.

(56) References Cited

U.S. PATENT DOCUMENTS 4,641,925 A * 2/1987 Gasparaitis et al. ..... 349/68

(Continued)

FOREIGN PATENT DOCUMENTS

JP 07-226191 8/1995

(Continued)

OTHER PUBLICATIONS

International Search Report for PCT/JP03/08252 mailed Oct. 14, 2003; ISA/JPO.

*Primary Examiner*—Karabi Guharay
*Assistant Examiner*—Anthony Canning
(74) *Attorney, Agent, or Firm*—Harness, Dickey & Pierce, P.L.C.

(57) ABSTRACT

An electrodeless self-ballasted fluorescent lamp includes: a luminous bulb 1 having a cavity portion 15; an induction coil 3 inserted in the cavity portion 15; a ballast 4 electrically connected to the induction coil 3; and a base 7, wherein the luminous bulb 1, the ballast 4 and the base 7 are configured as one unit. The luminous bulb 1 includes an approximately spherical outer tube 12 and an inner tube 11. At least the surface of the upper hemisphere of the outer tube 12 is coated with a silicone rubber 10 having the property of transmitting light.

13 Claims, 19 Drawing Sheets

U.S. PATENT DOCUMENTS

| | | | | | |
|---|---|---|---|---|---|
| 5,536,999 | A | * | 7/1996 | Winsor | 313/493 |
| 5,578,892 | A | * | 11/1996 | Whitman et al. | 313/112 |
| 5,621,266 | A | * | 4/1997 | Popov et al. | 313/46 |
| 5,708,331 | A | * | 1/1998 | Vamvakas et al. | 315/248 |
| 5,796,208 | A | * | 8/1998 | Girach | 313/493 |
| 6,097,137 | A | * | 8/2000 | Forsdyke et al. | 313/161 |
| 2003/0077454 | A1 | * | 4/2003 | Jing | 428/421 |

FOREIGN PATENT DOCUMENTS

| | | | |
|---|---|---|---|
| JP | 09-073880 | | 3/1997 |
| JP | 09320541 | A | 12/1997 |
| JP | 10-233110 | | 9/1998 |
| JP | 2000-277059 | | 10/2000 |
| JP | 2001-196194 | | 7/2001 |
| JP | 2002-124102 | | 4/2002 |

* cited by examiner (a)

(b)

(c)

Change in heat-resistance properties of shatter protective film (sample F) - Resilience Comparison between simulation result and accelerated test result (a) Comparison between simulation result and accelerated test result on bulb for low-W (corresponding to 60W incandescent bulb)

(b) Comparison between simulation result and accelerated test result on bulb for high-W (corresponding to 100W incandescent bulb)

Film thickness dependence of tensile strength

Film thickness dependence of elongation at break

FIG. 22

| Sample | A | B | C |
|---|---|---|---|
| Hardness[JIS A] | 30 | 16 | 52 |
| Tensile strength[MPa] | 1.0 | 0.7 | 3.7 |
| Elongation at break[%] | 130 | 200 | 240 |
| Shear adhesion[MPa] | 0.3 | 0.4 | 2.6 |

| Sample | D | E | F |
|---|---|---|---|
| Hardness[JIS A] | 28 | 53 | 43 |
| Tensile strength[MPa] | 2.4 | 4.5 | 7.7 |
| Elongation at break[%] | 290 | 390 | 740 |
| Shear adhesion[MPa] | 2.0 | 3.5 | 2.7 |

FIG. 23

| Sample | a | b | c |
|---|---|---|---|
| Hardness[JIS A] | 43 | 53 | 70 |
| Tensile strength[MPa] | 7.7 | 4.5 | 5.9 |
| Elongation at break[%] | 740 | 390 | 100 |
| Shear adhesion[MPa] | 2.7 | 3.5 | 2.0 |

FIG. 24

| | Initial value | Predicted value after 30,000 hours | | Leave under high temperature of 200°C | | |
|---|---|---|---|---|---|---|
| | | 125°C | 150°C | 48h | 100h | 240h |
| Hardness[JIS A] | 39 | 56 | 58 | 48 | 50 | 53 |
| Tensile strength[Mpa] | 7.7 | 7.2 | 6.8 | 7.5 | 7.2 | 6.5 |
| Elongation at break[%] | 740 | 530 | 460 | 500 | 440 | 350 |
| Resilience[Mpa·%] | 2849 | 1908 | 1564 | 1875 | 1584 | 1138 |

FIG. 25

Result of 3m-ceiling-height drop test on low-W
(corresponding to 60W incandescent bulb)

| Test condition | Resilience[MPa·%] | sample | Average film thickness [μm] | (Resilience) × (Film thickness) [N·%/m] | Shattering distance [cm] | Determination | Outward discoloration or the like |
|---|---|---|---|---|---|---|---|
| 200°C/48h | 1875 | ① | 107 | 2.01E+05 | 20 | Pass | None |
| | 1875 | ② | 103 | 1.93E+05 | 19 | Pass | None |
| | 1875 | ③ | 109 | 2.04E+05 | 24 | Pass | None |
| 200°C/100h | 1584 | ④ | 101 | 1.60E+05 | 13 | Pass | None |
| | 1584 | ⑤ | 106 | 1.68E+05 | 32 | Pass | None |
| | 1584 | ⑥ | 111 | 1.76E+05 | 18 | Pass | None |
| 200°C/240h | 1138 | ⑦ | 111 | 1.26E+05 | 14 | Pass | None |
| | 1138 | ⑧ | 115 | 1.31E+05 | 4 | Pass | None |
| | 1138 | ⑨ | 109 | 1.24E+05 | 5 | Pass | None |

FIG. 26

Result of 3m-ceiling-height drop test on high-W
(corresponding to 100W incandescent bulb)

| Test condition | Resilience[MPa·%] | sample | Average film thickness [μm] | (Resilience) × (Film thickness) [N·%/m] | Shattering distance [cm] | Determination | Outward discoloration or the like |
|---|---|---|---|---|---|---|---|
| 200°C/48h | 1875 | ① | 103 | 1.93E+05 | 40 | Pass | None |
| | 1875 | ② | 97 | 1.82E+05 | 23 | Pass | None |
| | 1875 | ③ | 97 | 1.82E+05 | 30 | Pass | None |
| 200°C/100h | 1584 | ④ | 102 | 1.62E+05 | 6 | Pass | None |
| | 1584 | ⑤ | 115 | 1.82E+05 | 10 | Pass | None |
| | 1584 | ⑥ | 107 | 1.69E+05 | 36 | Pass | None |
| 200°C/240h | 1138 | ⑦ | 104 | 1.18E+05 | 36 | Pass | None |
| | 1138 | ⑧ | 98 | 1.12E+05 | 38 | Pass | None |
| | 1138 | ⑨ | 112 | 1.27E+05 | 43 | Pass | None |

FIG. 27

Result of sealing-portion heat-shock destructive test on low-W (corresponding to 60W incandescent bulb)

| Test condition | Resilience [MPa·%] | sample | Film thickness on ruptured glass portion [μm] | Determination | Outward discoloration or the like |
|---|---|---|---|---|---|
| 200°C/48h | 1875 | ① | 81 | Pass | None |
| | 1875 | ② | 90 | Pass | None |
| | 1875 | ③ | 98 | Pass | None |
| 200°C/100h | 1584 | ④ | 87 | Pass | None |
| | 1584 | ⑤ | 97 | Pass | None |
| | 1584 | ⑥ | 80 | Pass | None |
| 200°C/240h | 1138 | ⑦ | 108 | Pass | None |
| | 1138 | ⑧ | 80 | Pass | None |
| | 1138 | ⑨ | 69 | Pass | None |

FIG. 28

Result of sealing-portion heat-shock destructive test on high-W (corresponding to 100W incandescent bulb)

| Test condition | Resilience [MPa·%] | sample | Film thickness on ruptured glass portion [μm] | Determination | Outward discoloration or the like |
|---|---|---|---|---|---|
| 200°C/48h | 1875 | ① | 86 | Pass | None |
| | 1875 | ② | 133 | Pass | None |
| | 1875 | ③ | 131 | Pass | None |
| 200°C/100h | 1584 | ④ | 82 | Pass | None |
| | 1584 | ⑤ | - | Test failure | None |
| | 1584 | ⑥ | 100 | Pass | None |
| 200°C/240h | 1138 | ⑦ | 102 | Pass | None |
| | 1138 | ⑧ | 110 | Pass | None |
| | 1138 | ⑨ | 116 | Pass | None |

ELECTRODELESS SELF-BALLASTED FLUORESCENT LAMP AND ELECTRODELESS DISCHARGE LAMP OPERATING APPARATUS

TECHNICAL FIELD

The present invention relates to electrodeless discharge lamp operating apparatus, and more particularly relates to electrodeless self-ballasted fluorescent lamps.

BACKGROUND ART

In recent years, in view of global environmental protection and cost effectiveness, self-ballasted fluorescent lamps with electrodes which are about five times as effective as incandescent lamps have been widely used to substitute the incandescent lamps in houses, hotels and other places. Such a self-ballasted fluorescent lamp with electrodes is disclosed in Japanese Laid-Open Publication No. 2001-196194, for example. Self-ballasted fluorescent lamps include ballasts and bases so that the lamps can be directly replaced with incandescent lamps in terms of structure.

In addition to the existing self-ballasted fluorescent lamps with electrodes, electrodeless self-ballasted fluorescent lamps are becoming widespread recently. The absence of electrodes eliminates wearing out of electrodes, and thus the electrodeless fluorescent lamps have a feature of longer life than that of the self-ballasted fluorescent lamps with electrodes. Therefore, the electrodeless fluorescent lamps are expected to become more and more widespread in future. Such an electrodeless self-ballasted fluorescent lamp is disclosed in Japanese Laid-Open Publication No. 9-320541, for example.

The electrodeless fluorescent lamps were mainly used for public lighting (e.g., street lighting) previously. However, after the appearance of electrodeless self-ballasted fluorescent lamps, the electrodeless fluorescent lamps came to be also used as a replacement of incandescent lamps in hotels and other places. Therefore, more attention needs to be paid to prevention of shattering caused by possible fracture than in conventional lamps.

Now, FIG. 20 shows the electrodeless self-ballasted fluorescent lamp disclosed in Japanese Laid-Open Publication No. 9-320541. FIG. 21 shows the self-ballasted fluorescent lamp with electrodes disclosed in Japanese Laid-Open Publication No. 2001-196194, for comparison.

As shown in FIG. 20, a spherical bulb 303 has a cavity portion for inserting an induction coil (306 and 307) therein. Though luminous gas is enclosed in the bulb 303, the bulb 303 is under a reduced pressure of several Pa to several hundred Pa. Films 301 and 302 shown in FIG. 20 are a conductive film and a luminophor, respectively. If the bulb 303 is broken in part, an implosion occurs toward the center of the bulb because of the reduced pressure inside the bulb 303. Accordingly, shattering is considered to occur more heavily than in a self-ballasted fluorescent lamp with electrodes.

Specifically, with respect to the self-ballasted fluorescent lamp with electrodes, though the inside of a tubular bulb 71 is under a reduced pressure as in a general fluorescent lamp, the tubular bulb 71 is surrounded with air and a globe 75 is disposed around the periphery thereof, as shown in FIG. 21. Accordingly, even if the bulb 71 is broken, the shatters are hold within the globe 75. Further, even if the globe 75 absorbs the shock of the shatters and is broken, no implosion occurs because the inside of the globe 75 is not under a reduced pressure. Even in the case of a lamp without the globe 75, as long as the lamp is a self-ballasted fluorescent lamp with electrodes, the force produced by the difference between the inside of the bulb and atmospheric pressure at the shattering is widely scattered along the center axis of the bulb because of the tubular shape of the bulb, so that the force is reduced as compared to the electrodeless self-ballasted fluorescent lamp in which the force is concentrated at the center of the spherical bulb. As a result, the shattering is suppressed in such a case.

Therefore, it is a main object of the present invention to provide a self-ballasted fluorescent lamp and an electrodeless discharge lamp operating apparatus capable of preventing shattering effectively even in a case where the lamp is broken and shatters.

DISCLOSURE OF INVENTION

A first electrodeless self-ballasted fluorescent lamp according to the present invention includes: a luminous bulb in which a luminous gas is enclosed and which has a cavity portion; an induction coil inserted in the cavity portion; a ballast electrically connected to the induction coil; and a base electrically connected to the ballast, wherein the luminous bulb, the ballast and the base are configured as one unit, the luminous bulb includes an approximately spherical outer tube and an inner tube defining the cavity portion, at least the surface of the upper hemisphere of the outer tube is coated with a silicone rubber having the property of transmitting light, and the following relationship is satisfied: $-58.271\mathrm{Ln}(T_{ave}\cdot\mathrm{Res})+711.03<100$ (Ln represents a natural logarithm) where Res is a resilience value [MPa·%] defined by multiplying the tensile strength [MPa], the elongation at break [%] and ½ out of the mechanical property values of the silicone rubber, and $T_{ave}$ is an average film thickness [μm] of the silicone rubber.

In addition, the relationship of $-58.271\mathrm{Ln}(T_{ave}\cdot\mathrm{Res})+711.03<75$ is preferably satisfied.

A second electrodeless self-ballasted fluorescent lamp according to the present invention includes: a luminous bulb in which a luminous gas is enclosed and which has a cavity portion; an induction coil inserted in the cavity portion; a ballast electrically connected to the induction coil; and a base electrically connected to the ballast, wherein the luminous bulb, the ballast and the base are configured as one unit, the luminous bulb includes an approximately spherical outer tube and an inner tube defining the cavity portion and is for a lamp of high wattage having a rated luminous flux corresponding to a 100 W incandescent bulb, at least the surface of the upper hemisphere of the outer tube is coated with a silicone rubber having the property of transmitting light, and the following relationship is satisfied: $T_{thin}\geqq-26.453\mathrm{Ln}(\mathrm{Res})+263.54$ (Ln represents a natural logarithm) where Res is a resilience value [MPa·%] defined by multiplying the tensile strength [MPa], the elongation at break [%] and ½ out of the mechanical property values of the silicone rubber, and $T_{thin}$ is a minimum required film thickness [μm] of the silicone rubber.

A third electrodeless self-ballasted fluorescent lamp according to the present invention includes: a luminous bulb in which a luminous gas is enclosed and which has a cavity portion; an induction coil inserted in the cavity portion; a ballast electrically connected to the induction coil; a base electrically connected to the ballast, wherein the luminous bulb, the ballast and the base are configured as one unit, the luminous bulb includes an approximately spherical outer tube and an inner tube defining the cavity portion and is for a lamp of low wattage having a rated luminous flux corresponding to a 60 W incandescent bulb, at least the surface of the upper hemisphere of the outer tube is coated with a silicone rubber having the property of transmitting light, and the following relationship is satisfied: $T_{thin} \geqq -24.232 \ln(Res)+238.53$ (Ln represents a natural logarithm) where Res is a resilience value [MPa·%] defined by multiplying the tensile strength [MPa], the elongation at break [%] and ½ out of the mechanical property values of the silicone rubber, and $T_{thin}$ is a minimum required film thickness [μm] of the silicone rubber.

It is preferable that substantially the entire surface of the outer tube is coated with the silicone rubber. Not only the surface of the upper hemisphere of the outer tube but also the surface of the lower hemisphere thereof is preferably coated with the silicone rubber.

In one embodiment of the present invention, the silicone rubber is a silicone rubber in which an aromatic functional group has been introduced to absorb visible light in the blue range.

In another embodiment of the present invention, a thin film having a color-filtering function is formed over the coating of the silicone rubber or between the coating of the silicone rubber and the surface of the outer tube.

In still another embodiment of the present invention, a thin film having the function of absorbing ultraviolet rays is formed over the coating of the silicone rubber or between the coating of the silicone rubber and the surface of the outer tube.

In yet another embodiment of the present invention, a thin film having a photocatalytic function is formed over the coating of the silicone rubber.

In still another embodiment of the present invention, a thin film made of a polymeric resin is formed over the coating of the silicone rubber.

An electrodeless discharge lamp operating apparatus according to the present invention includes a luminous bulb having a cavity portion, wherein a shatter protective film made of a silicone rubber is formed over the outer surface of the luminous bulb.

In one preferred embodiment of the present invention, a luminescent layer is formed on at least part of the inner surface of the luminous bulb. The luminescent layer is preferably formed substantially over the entire inner surface of the outer tube of the luminous bulb.

In another embodiment of the present invention, a luminescent layer is formed on the shatter protective film or between the shatter protective film and the outer surface of the luminous bulb.

The silicone rubber may be a silicone rubber in which a luminophor is mixed.

BRIEF DESCRIPTION OF DRAWINGS

FIG. 22 is a table showing physical property values of silicone used in a drop test.

FIG. 23 is a table showing physical property values of silicone used in a heat-shock forced destructive test.

FIG. 24 is a table showing predicted physical property values of a sample F after 30,000-hour operation.

FIG. 25 is a table showing results of drop tests after heat-resistance accelerated tests performed on a low-W luminous bulb.

FIG. 26 is a table showing results of drop tests after heat-resistance accelerated tests performed on a high-W luminous bulb.

FIG. 27 is a table showing results of heat-shock forced destructive tests on a sealing portion after tests of the life expectancy under heated conditions performed on a low-W luminous bulb.

FIG. 28 is a table showing results of heat-shock forced destructive tests on a sealing portion after tests of the life expectancy under heated conditions performed on a high-W luminous bulb.

BEST MODE FOR CARRYING OUT THE INVENTION

Figure 1:
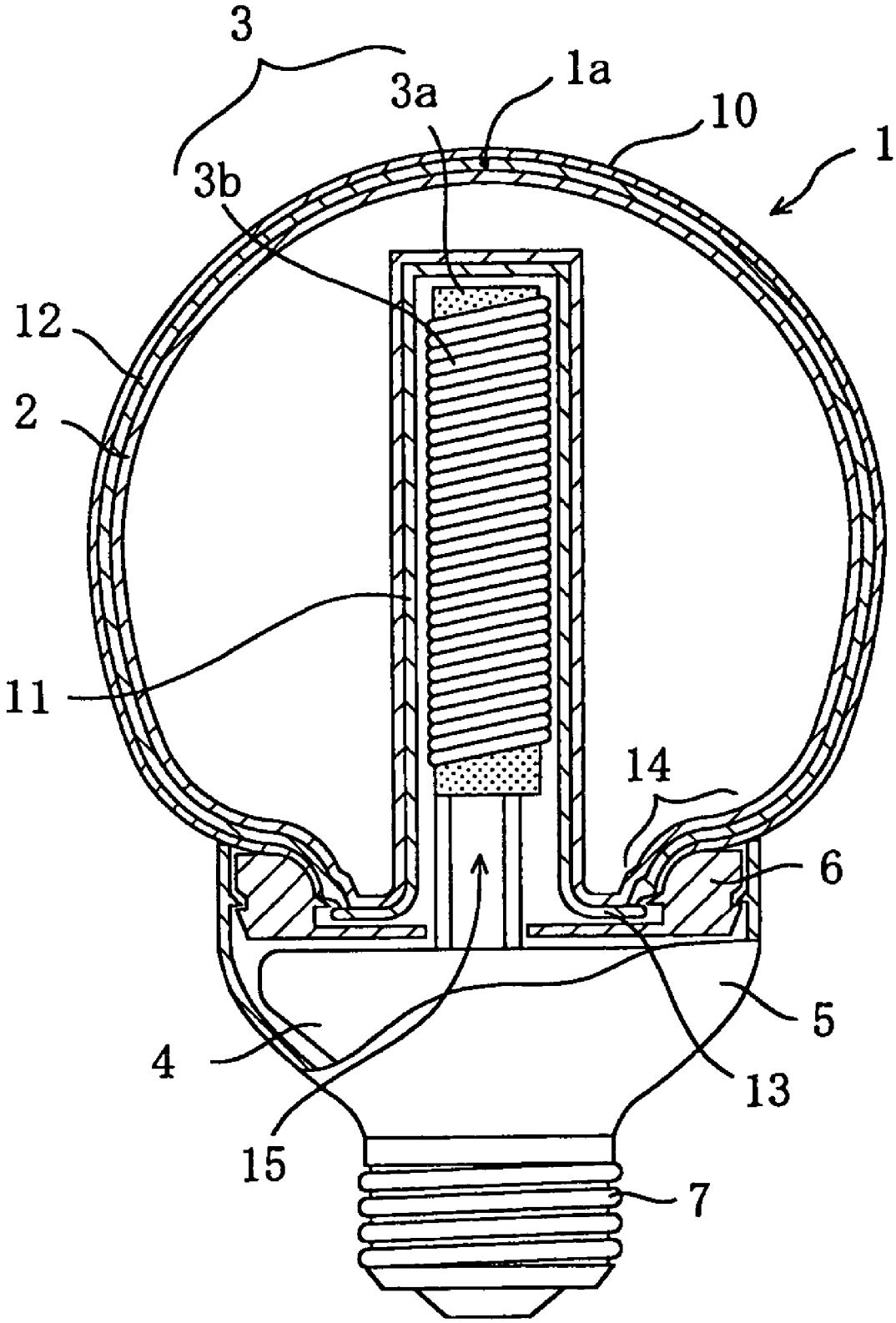
FIG. 1 is a cross-sectional view schematically showing a configuration of an electrodeless self-ballasted fluorescent lamp according to a first embodiment of the present invention.

The present inventors came up with an idea of forming a thin film of a resin over the surface of a luminous bulb for an electrodeless self-ballasted fluorescent lamp to prevent shattering effectively when the electrodeless self-ballasted fluorescent lamp is broken and shatters. Though luminous bulbs (bulbs) are covered with coatings in some tubular or circular fluorescent lamps other than electrodeless self-ballasted fluorescent lamps, there was no idea what kind of coating should be applied to the electrodeless self-ballasted fluorescent lamps at the beginning of the investigation. This is because of the following reasons.

In the tubular and circular fluorescent lamps, the surface of the outer tube is coated with a heat-shrinkable tube made of a heat-shrinkable polyester resin or vinyl chloride-based film in some cases so that the heat-shrinkable tube is processed by heating to adhere to the surface of the outer tube. However, this causes problems of low flexibility in shape and of a short life expectancy under heated conditions. Supposing the function of a shatter protective film is insured until the end of the life of the lamp, neither a film with low flexibility in shape nor a film with a short life expectancy under heated conditions can be used for an electrodeless self-ballasted fluorescent lamp whose life is longer than that of a general fluorescent lamp with electrodes because the luminous bulb thereof is approximately spherical and is heated to high temperatures during operation.

In addition, though some electrodeless self-ballasted fluorescent lamps used for public lighting are placed outdoors, the heat-shrinkable tubes used for the straight/circular fluorescent lamps have poor weatherability. As a result, there arises a problem in using the heat-shrinkable tube for the electrodeless self-ballasted fluorescent lamps. Moreover, the use of vinyl chloride-based materials also has a problem in terms of environmental pollution. With respect to the tubular/circular fluorescent lamps, coating of a urethane resin has been examined. However, if the urethane resin is used for the electrodeless self-ballasted fluorescent lamps, it is difficult to insure the function of the coating until the end of the lamp life because of the low heat resistance and poor weatherability of the coating.

Examples of materials excellent in heat resistance and weatherability include Teflon (registered trademark, also called "PTFE"). However, Teflon requires the process of spraying a coating of a primer, which is an adhesive, on the glass surface, then spraying powdery Teflon and dissolving the powdery Teflon in an electric furnace to cover the glass surface with a coating. Therefore, the process using Teflon is difficult, and thus Teflon is not suitable for coatings on electrodeless self-ballasted fluorescent lamps. In addition, Teflon has another drawback of high cost. In order to merely protect the bulb of the electrodeless self-ballasted fluorescent lamp with the fact that the lamp is a light source ignored, techniques of using a thick coating of a resin or of disposing a material such as metal around the lamp might be effective. However, such techniques are not suitable for the cases of maintaining the luminous intensity distribution and the design of the electrodeless self-ballasted fluorescent lamp and of minimizing the decrease of the luminous flux.

In addition, attention should be paid to a peculiar problem of electrodeless self-ballasted fluorescent lamps. An electrodeless self-ballasted fluorescent lamp (or electrodeless discharge lamp) having a cavity portion for inserting an induction coil therein includes an inner tube defining the cavity portion and an outer tube defining an outside shape of the bulb, and the inner tube and the outer tube are sealed and connected to each other. Accordingly, strains or microcracks created during processing are likely to remain around the sealed portion. Therefore, when subjected to heat or a physical shock, the sealing portion for sealing and connecting the inner tube and the outer tube is easily damaged.

Through experiments, the present inventors confirmed that if the bulb (luminous bulb) is damaged, a phenomenon called "implosion" occurs because the pressure inside the bulb is extremely lower than the external pressure (atmospheric pressure), so that the cavity portion (inner tube) breaks through the outer tube and causes the glass to shatter. This phenomenon is not observed in a fluorescent lamp with electrodes though the lamp with electrodes and the electrodeless self-ballasted fluorescent lamp are both the self-ballasted lamps. This is because a globe is provided around the bulb in the self-ballasted fluorescent lamp with electrodes as well as the bulb is not configured by inner and outer tubes and no cavity portion defined by an inner tube is provided. Specifically, the electrodeless self-ballasted fluorescent lamp needs a special protection against shattering at the damage, considering its peculiarities such as the configuration including the inner and outer tubes and the exposed luminous bulb. In addition, since the electrodeless self-ballasted fluorescent lamp has a feature of a long life as an electrodeless fluorescent lamp, a coating film (shatter protective film) for preventing shattering at the damage requires excellent properties for a long life expectancy under heated conditions. As already described above, the film, of course, must have the properties of being processed relatively easily and a sufficient flexibility in shape.

In other words, at the beginning of the investigation, none of the material properties required of the shatter protective film were clear, and it could not be judged what are the criteria in investigating optimum materials. Under these circumstances, the present inventors clarified the criteria for material investigation and finally succeeded in finding out the conditions required of a shatter protective film suitable for electrodeless self-ballasted fluorescent lamps and material properties required of the film after much trial and error, thus leading to the present invention.

Hereinafter, embodiments of the present invention will be described with reference to the drawings. In the drawings, each member having substantially the same function will be identified by the same reference numeral for simplicity. The present invention is not limited to the following embodiments.

(Embodiment 1)

Figure 2:
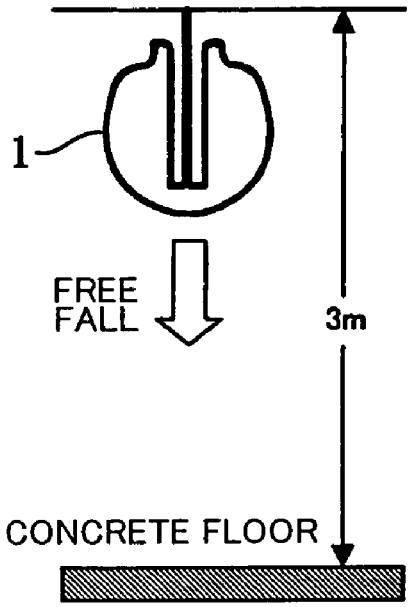
FIG. 2 is a view for explaining a drop test.
Figure 3:
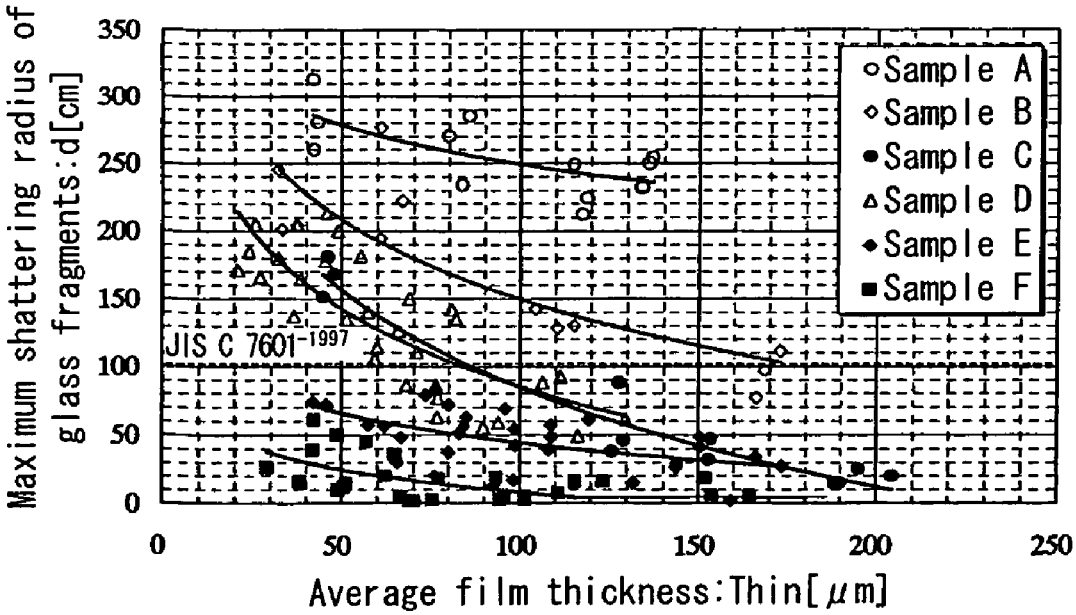
FIG. 3 is a graph showing a relationship between the average thickness (Thin) of each silicone thin film and the degree of shattering (d).

Referring to FIGS. 1 through 3, an electrodeless discharge lamp operating apparatus and an electrodeless self-ballasted fluorescent lamp according to a first embodiment of the present invention will be described.

FIG. 1 schematically shows a configuration of an electrodeless discharge lamp operating apparatus (an electrodeless self-ballasted fluorescent lamp) of this embodiment. The electrodeless discharge lamp apparatus of this embodiment includes a luminous bulb (bulb) 1 having a cavity portion 15. The outer surface of the luminous bulb 1 is coated with a silicone rubber 10 having the property of transmitting light. A luminescent layer 2 is formed on at least part of the inner surface of the luminous bulb 1.

The electrodeless discharge lamp apparatus shown in FIG. 1 is an electrodeless self-ballasted fluorescent lamp in which the luminous bulb 1 is integrated with a ballast 4 and a base 7. A shatter protective film 10 made of a silicone rubber is formed on substantially the entire outer surface of the luminous bulb 1. The luminous bulb 1 includes: an inner tube 11 defining the cavity portion 15 into which an induction coil 3 is inserted; and an outer tube 12 defining the outer surface of the luminous bulb 1. The approximately cylindrical inner tube 11 and the approximately spherical outer tube 12 are sealed and connected to each other at their ends in a sealing portion (connecting portion) 13. A neck portion 14 is disposed around the sealing portion 13. The glass portion of the luminous bulb 1 has a thickness of 0.8 to 2.0 nm. If the luminous bulb 1 is a luminous bulb for a lamp of high wattage corresponding to a 100 W incandescent bulb, the glass thickness is 1.0±0.2 mm on average at the upper hemisphere (opposite the base 7). If the luminous bulb 1 is a luminous bulb for a lamp of low wattage corresponding to a 60 W incandescent bulb, the glass thickness is 1.3±0.2 mm on average at the upper hemisphere.

The induction coil 3 includes a core 3*a* made of ferrite; and a coil 3*b* wounded around the core 3*a*. The coil 3*b* is electrically connected to the ballast 4. A cover 5 is provided around the ballast 4. A base 7 is electrically connected to the ballast 4 and provided at the bottom of the cover 5. In the example shown in FIG. 1, a holder 6 is provided between the luminous bulb 1 and the ballast 5. The holder 6 holds and fixes the luminous bulb 1 by an engagement with the luminous bulb 1. The holder 6 itself is held and fixed by an engagement with the cover 5.

The shatter protective film 10 is required to cover at least a top portion (vertex point 1*a*) of the outer tube 12 in order to prevent the inner tube 11 (cavity portion) from breaking through the outer tube 12 due to the damage to the sealing portion in which the inner tube 11 and the outer tube 12 are sealed and connected. The range of the "top portion" may be within an area of the surface of the outer tube 12 defined in cross-section by two lines which extend upward substantially from the tip of the inner tube 11 at 45° symmetrically with respect to the vertical axis of the inner tube 11. Alternatively, the range may be an area of the outer tube 12 within a radius of 25 mm of the vertex point 1*a*. The shatter protective film 10 preferably covers the upper hemisphere of the outer tube 12 (corresponding to "the Northern Hemisphere", assuming that the outer tube 12 of the luminous bulb 1 is the Earth). The "upper hemisphere" may be the area higher than the half of the height of the outer tube 12. If it can be assumed that the outer tube 12 is spherical or substantially spherical, the "upper hemisphere" is the area higher than the great circle (equator). To prevent the outer tube 12 from suffering a shock from outside over the entire surface thereof, it is further preferable to cover substantially the entire outer surface of the outer tube 12 of the luminous bulb 1.

Now, the reason for selecting a silicone rubber having the property of transmitting light as a material for the shatter protective film 10 will be described. Silicone rubber has never been used for the shatter protective film 10 in any of the electrode-included/electrodeless fluorescent lamps and the tubular/circular fluorescent lamps. However, the present inventors focused this material in the selection of materials from the viewpoints of heat resistance and weatherability.

Mechanical strength properties of silicone rubber include hardness, tensile strength, elongation at break and shear adhesion. It has not been known which one of these properties is important as a parameter for the function as the shatter protective film 10. In other words, no relations between the shattering preventing function and values of these physical properties have been known. Therefore, it is necessary to find out physical properties required of a shatter protective film for an electrodeless self-ballasted fluorescent lamp. The present inventors succeeded in deriving the conditions required of the shatter protective film 10 only from two material parameters of "tensile strength" and "elongation at break" and one design parameter of "film thickness (distribution)" through a large number of experiments. The required conditions are described below. In the following inequalities, "Ln" is a natural logarithm.

Figure 4:
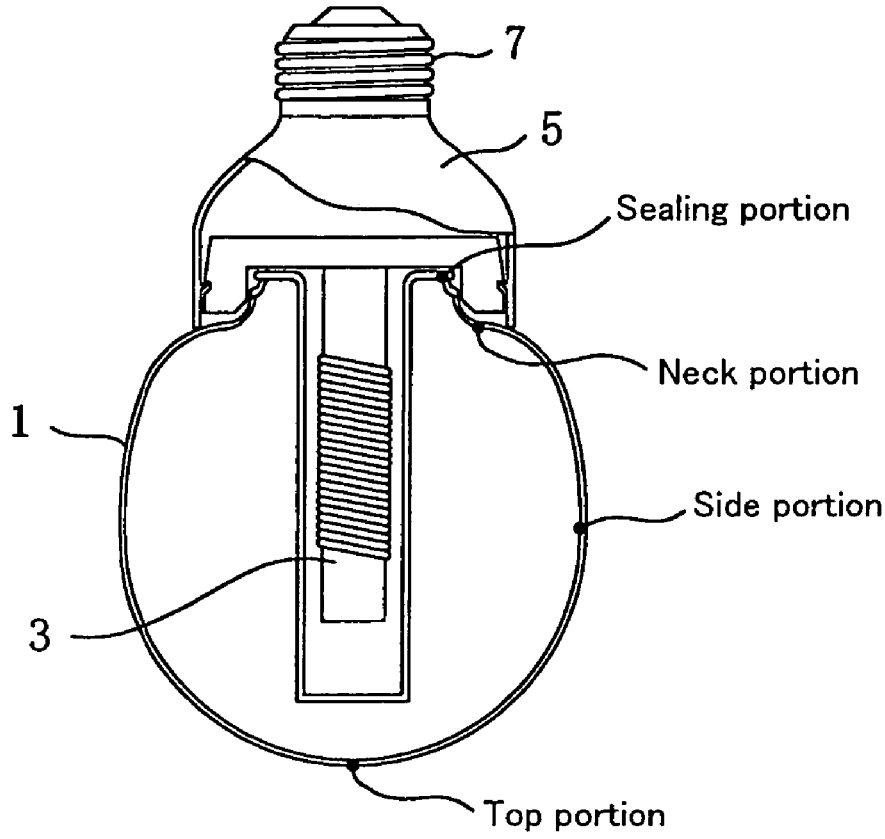
FIG. 4 is a cross-sectional view for describing respective components of the electrodeless self-ballasted fluorescent lamp.

(1) If the luminous bulb is a luminous bulb for a lamp of high wattage corresponding to a 100 W incandescent bulb (hereinafter, referred to as a "high-W"), the following inequality is satisfied:

$$T_{thin} \geqq -26.453 Ln(\text{Res}) + 263.54$$

where Res is the resilience value [MPa·%] defined by multiplying the tensile strength [MPa], the elongation at break [%] and ½ out of the mechanical property value of the silicone rubber, and $T_{thin}$ is the minimum required film thickness [μm] of the silicone rubber at the top portion or the upper hemisphere (in the area from the top portion to the side portion (see FIG. 4)).

(2) If the luminous bulb is a luminous bulb for a lamp of low wattage corresponding to a 60 W incandescent bulb (hereinafter, referred to as a "low-W"), $$T_{thin} \geqq -24.232 Ln(\text{Res}) + 238.53$$

is satisfied.

Alternatively, the following conditions may be established.

(3) If substantially the entire surface of the outer tube is coated with the silicone rubber, the following inequality may be satisfied:

$$-58.271 Ln(T_{ave} \cdot \text{Res}) + 711.03 < 100$$

where $T_{ave}$ is the average film thickness [μm] of the silicone rubber. In this case, the luminous bulb may be any one of the high-W luminous bulb and the low-W luminous bulb.

More preferably, $$(4)\ -58.271 Ln(T_{ave} \cdot \text{Res}) + 711.03 < 75$$

is satisfied.

Experiments and studies done by the present inventors to obtain the foregoing conditions will be described hereinafter.

[Experiment and Study on Materials for Shatter Protective Film]

First, to obtain preferred conditions for a shatter protective film, it is preferable to define criteria for quality evaluation with the actual use in mind. Therefore, it is necessary to clarify the relationship between "cause" and "way of fracture" with respect to the "fracture" of the luminous bulb. A cause of the fracture of a lamp is considered to be damage to a glass bulb due to a mechanical/thermal shock from the outside.

Examples of mechanical shocks include a drop during operation, transfer for shipment or fabrication assembly and a possible damage when the bulb is directly hit by an object. Examples of thermal shocks are considered to include a case where a luminous bulb heated during outdoor operation is splashed with rain and a case of damage due to the growth of microcracks created by the stress of repeating thermal expansion and shrinkage in turning on and off the lamp.

From the above consideration, the present inventors concluded that it is appropriate to conduct the evaluation with a drop test also from a practical point of view and that the test should be in conformity with the standard for a drop test of dropping a lamp from a ceiling height of 3 m in JIS C $7601^{-1997}$ which is a standard for fluorescent lamps for general lighting service. Regarding the thermal shock, it is considered to be required that no glass shatters break and are scattered through the film when the sealing portion (connecting portion) which has a remaining strain after the processing of the glass and thus is susceptible to microcracks is destroyed by a heat shock.

<Evaluation Result>

First, the drop test will be described. In the drop test (JIS C $7601^{-1997}$), the luminous bulb 1 is allowed to fall freely from a ceiling height of 3 m so that the maximum shattering distance (radius) of the glass shattering from the falling point was measured as shown in FIG. 2. According to JIS, the distance of 1 m or less is defined as a standard for general fluorescent lamps with shatter protective films. From the two facts that the height of the buildings such as public facilities is generally 3 m (the height of houses is 3 m or less) and that maximum glass shattering distances of 1 m or less exhibits an extremely low possibility of danger of causing serious injury when a fragment enters one's eye in consideration of the height of one's eyes, the evaluation criteria of the present invention are expected to be a general indicator of safety not only in Japan but also throughout the world.

To clarify the properties required of the shatter protective film, thin films made of several types of silicone rubbers having different physical property values are formed over the entire outer surface of the respective luminous bulbs, and the drop test is performed using the luminous bulb. FIG. 22 shows silicone rubbers used for the drop test and the physical properties thereof. All the samples A through F were purchased from GE Toshiba Silicone Co. Ltd.

FIG. 3 shows relationships between the thicknesses of the respective silicone thin films and the degree of shattering obtained as a result of the drop test. The abscissa of FIG. 3 indicates the average thicknesses of the thin films formed over the luminous bulb 1. The ordinate represents the flying distance of a glass fragment which flied over the longest distance when the luminous bulb 1 shatters.

The reason for using the average film thickness is that the damaged portion of the luminous bulb 1 which has collided with the floor was not the same and was distributed in a large area from the top portion of the luminous bulb 1 to the sealing portion (see FIG. 4) in the drop test, and thus taking the average value of film thickness was considered to be sufficient. Even if the film thickness was varied from the top portion to the sealing portion within the same average film thickness range, the variation was within tolerance and no significant difference was shown. In addition, though the thickness of the glass differs between the low-W and the high-W, no significant difference was shown therebetween and the glass-thickness difference was small enough to be within the tolerance in the evaluation results. Therefore, data (dots) shown in FIG. 3 are plotted with the data on the low-W and the high-W mixed.

As shown in FIG. 3, the degree of shattering of glass fragments is greatly affected by the elongation at break and the tensile strength (+film thickness) out of the mechanical properties of silicone, and the sample F excellent in tensile strength and elongation (elongation at break) exhibits the best result.

Figure 5:
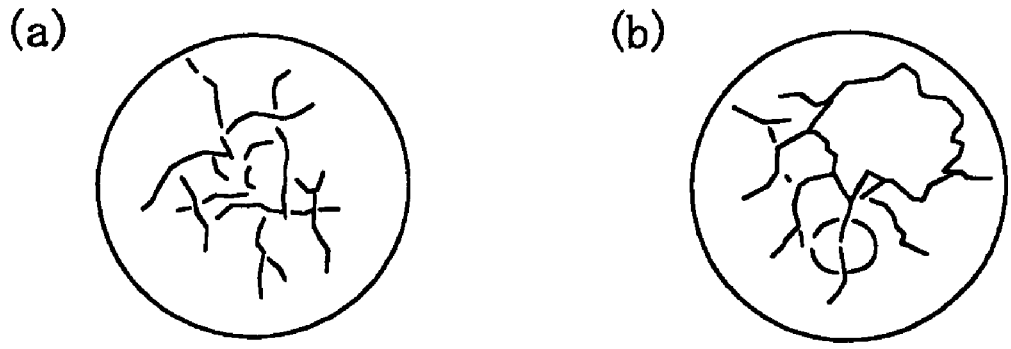
FIG. 5(*a*) is an illustration in which the shattering of the glass is suppressed by a film and FIG. 5(*b*) is an illustration in which the glass shatters through the film.

Now, a heat-shock forced destructive test will be described. Microcracks are created in the sealing portion (see FIG. 4) and the sealing portion which has been heated with an electric plate is forcedly cooled with iced water, thereby damaging the sealing portion. Then, the inner tube hits the outer tube by implosion to break the glass. If the shattering of the glass is prevented by the film, the result is determined to be "OK" (see FIG. 5(*a*)), while being determined to be "NG" if the inner tube breaks through the film to cause the glass to shatter (see FIG. 5(*b*)).

Figure 6:
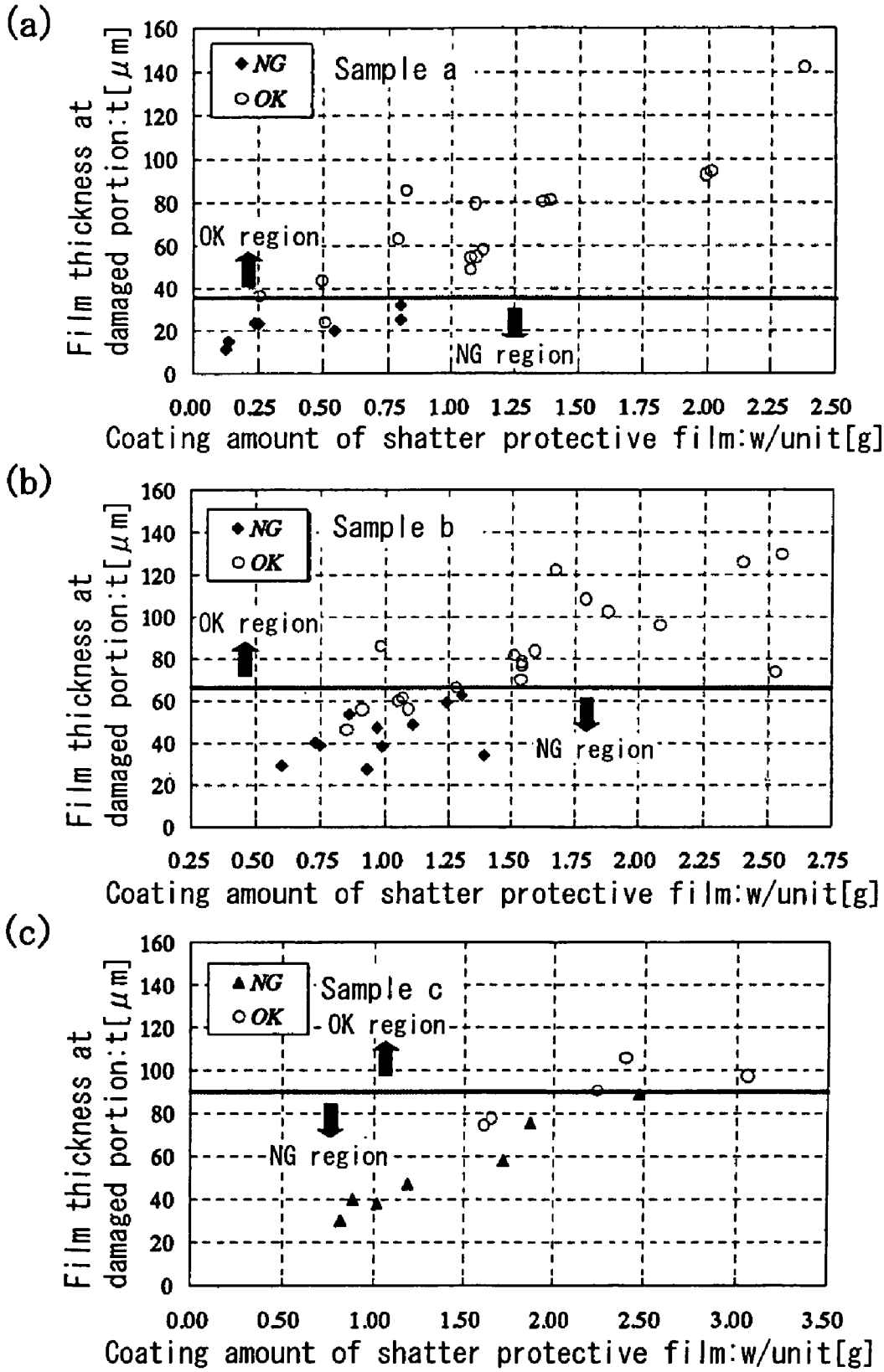
FIGS. 6(*a*) through 6(*c*) are graphs showing results of a forced destructive test performed on a sealing portion for samples a through c, respectively, in the case of a high-W.
Figure 7:
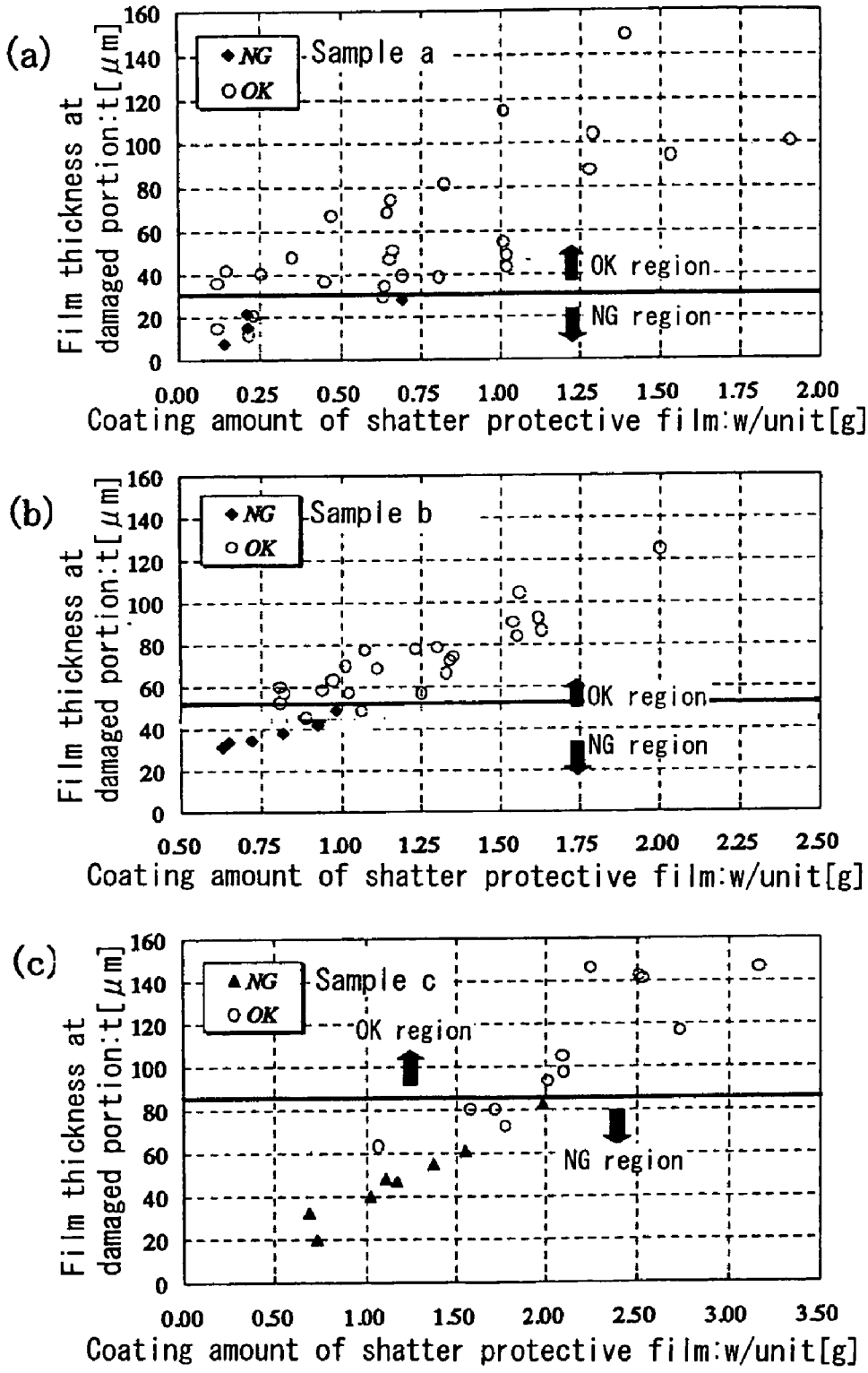
FIGS. 7(*a*) through 7(*c*) are graphs showing results of a forced destructive test performed on a sealing portion for samples a through c, respectively, in the case of a low-W.

To clarify the required properties and film thickness for silicone to prevent the inner tube which has burst out like a bullet due to the damage to the sealing portion from breaking through the outer tube to cause the glass to shatter, shatter protective films were formed using three types of silicones greatly differing in physical property values and a forced destructive test was conducted. FIG. 23 shows the three types of silicones and the physical properties thereof. FIGS. 6 and 7 show results of the forced destructive test.

FIG. 6 is a graph regarding a luminous bulb for a high-W (corresponding to a 100 W incandescent bulb), and FIG. 7 is a graph regarding a luminous bulb for a low-W (corresponding to a 60 W incandescent bulb). The physical property values of samples a through c are shown in FIG. 23. All the samples a through c were purchased from GE Toshiba Silicone Co. Ltd. The sample a is the same as the sample F, and the sample b is the same as the sample E.

In FIGS. 6 and 7, the abscissa indicates the amount of the coating per one luminous bulb and the ordinate indicates the film thickness of the silicone coating at the ruptured portion of the glass broken by the heat-shock forced destructive test. Even with the same amount of the coating, the film thickness of the ruptured portion varies because the luminous bulb is broken at different portions by the impact of the inner tube bursting out and because the film thickness differs among these portions. In addition, the evaluation results obtained using the amount of the coating is equal to the evaluation results obtained using the average film thickness, and both the determinations "OK" and "NG" are made even with the same amount of the coating. This implies that it is more important to set the minimum film thickness than to set the average film thickness.

With respect the sample a, the boundary between "OK" and "NG" is 35 μm for the high-W and 30 μm for the low-W, thus defining the minimum film thickness in the film thickness distribution. In the same manner, with respect to the sample b, the boundary between "OK" and "NG" is 65 μm for the high-W and 55 μm for the low-W. With respect to the sample c, the boundary between "OK" and "NG" is 95 μm for the high-W and 85 μm for the low-W.

Once the above materials are selected, the respective film thicknesses required for preventing "fracture", i.e., the bursting out of the inner tube to make the glass shatter at an initial stage, are determined. However, to achieve the effect of preventing glass shattering until the end of the life of the lamp, the initial strength needs to be set high in consideration of change (deterioration) with time of the adopted silicone material. In this case, factors and values required as physical property values should be clarified. Therefore, based on the test results on the silicones having different physical properties, the required physical property values were further investigated.

From the above experimental results, it was found that the physical properties required of a material for a shatter protective film are represented by two material parameters of "tensile strength" and "elongation at break" and one design parameter of "film thickness (distribution)". In this case, the tensile strength and the film thickness represent the strength of the film, and the elongation at break represents the "elasticity" of the material, i.e., these three parameters determine the function of absorbing a shock from the outside. If these parameters are correlated with the degree of shattering of the glass, "the degree of fracture" can be derived from the physical property values.

The "resilience", which is a material rheological property, is obtained by correlating the tensile strength and the elongation (elongation percentage) to each other. The resilience is the maximum work load that is stored as an elastic energy, which disappears when an external force is removed, and the resilience is also a value serving as an index for measuring the ability of a material to store the elastic energy.

Figure 8:
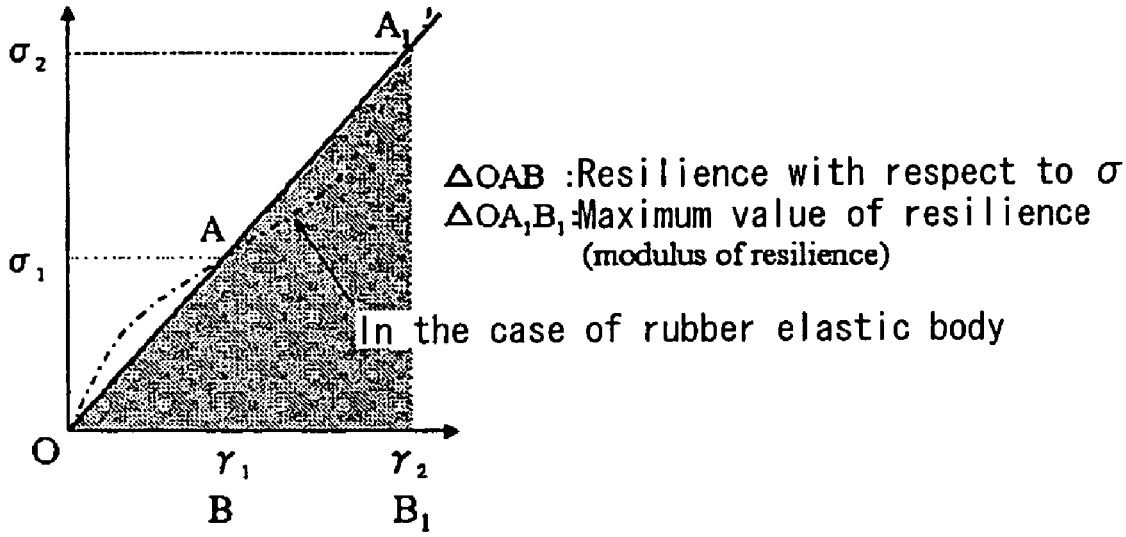
FIG. 8 is a graph showing a relationship between "stress σ" and "strain γ".

In a case where the elasticity adheres Hooke's Law, the relationship between "stress σ" and "strain γ" is represented as the line shown in the graph of FIG. 8, and the resilience with respect to the stress σ is given by the area defined by ΔOAB [Kyoritsu Shuppan Co., Ltd. "KAGAKU DAI JITEN (Chemical Dictionary), p887"]. With respect to a rubber elastic body, this relationship is expressed non-linear in a strict sense, i.e., is not linear. However, from a macroscopic viewpoint of the qualitative behavior, the relationship is approximately linear and it can be said that the relationship adheres to Hooke's Law representing an ideal elasticity.

Since the relationships of (tensile strength)=(stress) and of (elongation)=(elongation at break) are established with respect to material properties, the definition of "(resilience)=(tensile strength [MPa])×(elongation at break [%])×½[MPa·%]" is introduced, thereby analyzing the above data.

<Analysis on Drop Test>

Figure 9:
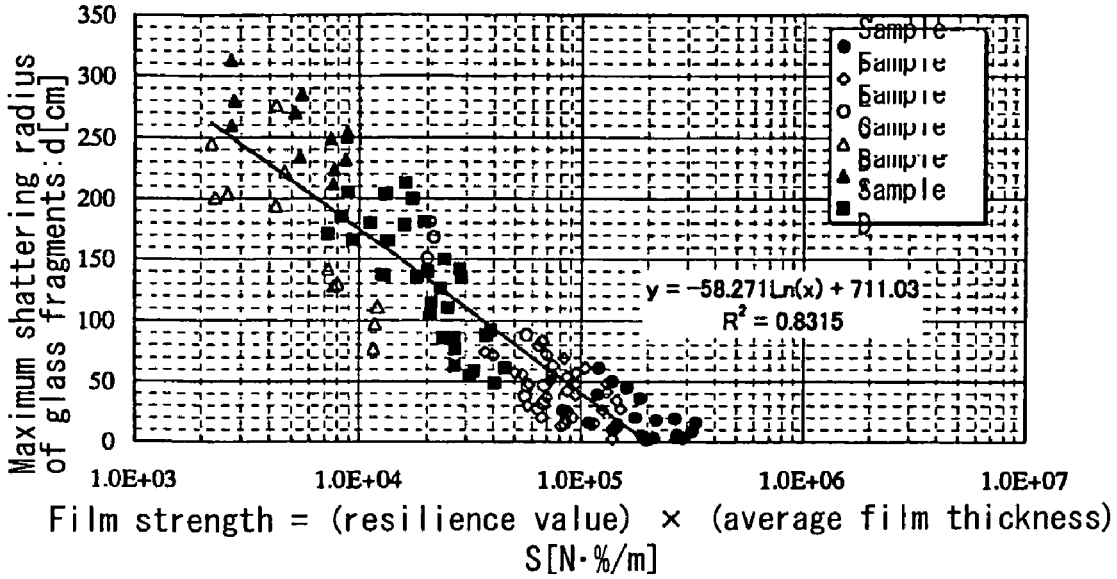
FIG. 9 is a graph showing a relationship between the film strength [N·%/m] and the maximum shattering radius [cm] of glass fragments.

Based on the data obtained from the drop test, the concept of resilience is introduced and the shattering degree is analyzed. The "resilience" is calculated using the "tensile strength" and the "elongation at break" of the silicone materials, plotting the film strength [N·%/m] obtained from the equation of (resilience [MPa·%])×(average film thickness [μm])=(film strength [N·%/m]) in the abscissa and the maximum shattering distance (cm) of the glass in the ordinate. The result is shown in FIG. 9.

If fitting is performed on the shattering degree of the glass using a logarithmic function, an approximation thereof is obtained by the following equation:

$$d=-58.271Ln(S)+711.03 \quad \text{(Equation 1)}$$

d: the maximum shattering distance of glass fragments [cm]

S: the film strength=(resilience)×(average film thickness) [N·%/m]

Once the material physical property (resilience) and the average film thickness are obtained from Equation 1, the degree of glass shattering upon the drop can be predicted. Specifically, the required film thickness can be fed back to the initial design easily in consideration of the change in the resilience in a case where the material is changed with time and deteriorated by heat, ultraviolet rays, humidity or fatigue due to repeated stress.

To conform to JIS, the film strength should be designed to satisfy d<100. Since the resilience is a physical property value peculiar to the material, the resilience is determined by selecting the material. That is, a designer must determine the film thickness with selection of the material. Considering the fact that the variation in value is approximately ±25% as a characteristic of the destructive test, it is sufficient to design to satisfy d<75 to 50.

In the above experiment, the drop test is performed using a luminous bulb only. However, the same result is obtained with a similar experiment using a luminous bulb integrated with a circuit housing. This is considered to be because the housing and the luminous bulb are secured to each other so that the shatters are less likely to fly though total weight is heavy. Specifically, if a lamp falls from the ceiling for some reason during its operation, there are two possible cases: a case where only the luminous bulb falls; and a case where the luminous bulb falls together with the housing (including a ballast). The above experimental result is also applicable to the latter case on the analogy of the test of dropping the luminous bulb only.

<Analysis on Heat-Shock Forced Destructive Test>

Figure 10:
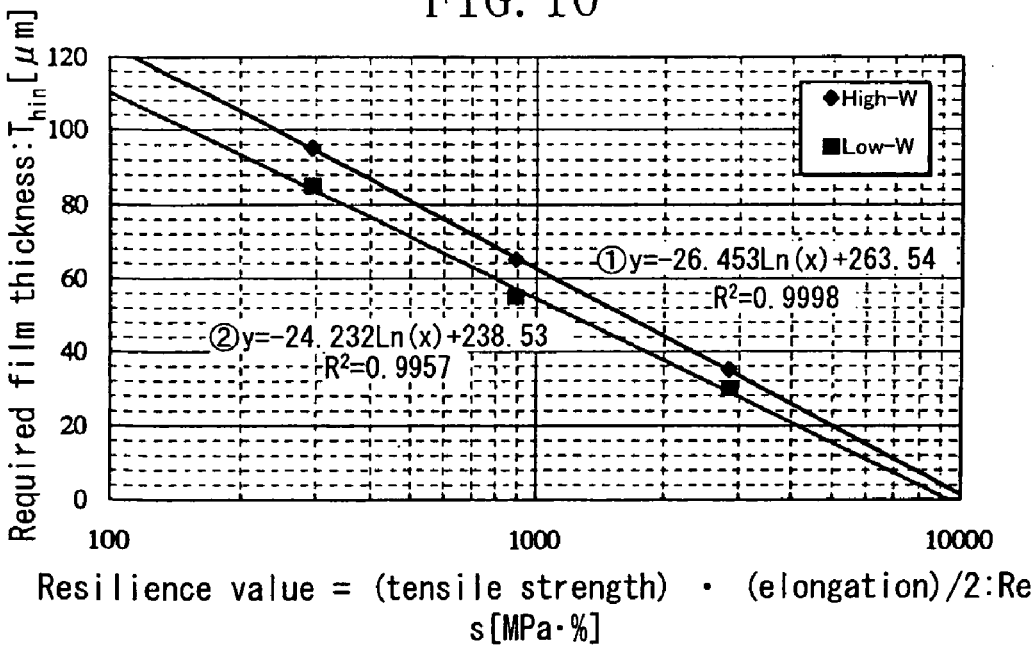
FIG. 10 is a graph showing a relationship between the resilience value and the required film thickness.

In the heat-shock forced destructive test performed on the sealing portion in which the inner tube and the outer tube are sealed and connected to each other, the concept of "resilience" is also introduced in the same manner to obtain the minimum film thickness (required film thickness) for obtaining the required strength of a shatter protective film used for an electrodeless fluorescent lamp corresponding the physical property value peculiar to a material (resilience). The result is shown in FIG. 10.

The thickness required for the shatter protective film to suppress shattering of the glass even if the inner tube bursting out by "implosion" due to the difference between the internal pressure and the external pressure breaks through the outer tube to cause the glass to shatter is approximated as a relationship between the resilience and the required film thickness using a logarithmic function as follows:

$$\text{High-W: } T_{thin}=-26.453Ln(\text{Res})+263.54 \quad \text{(Equation 2)}$$

$$\text{Low-W: } T_{thin}=-24.232\ Ln(\text{Res})+238.53 \quad \text{(Equation 3)}$$

$T_{thin}$: the required film thickness for preventing shattering [μm]

Res: the resilience=(tensile strength)×(elongation at break)×½[MPa·%]

From Equations 2 and 3, the required film thickness for each of the high-W and the low-W with different glass thicknesses is determined, so that the required film thickness can be fed back to the initial design in consideration of a resilience value when the material physical property (resilience) is changed with time (in a case where the material is deteriorated by heat, ultraviolet rays, humidity or fatigue due to repeated stress).

As a result of a study on material physical properties required of a shatter protective film for an electrodeless self-ballasted fluorescent lamp based on the "drop test" and the "heat-shock forced destructive test", the present inventors found for the first time that the "resilience" is a factor necessary for the design of the film.

Specifically, in designing a shatter protective film, the film thickness thereof is preferably as small as possible. Therefore, the material having the most excellent tensile strain and elongation at break (the samples F and a) are preferably selected as a material for the shatter protective film. The thickness of the film is determined after determination of how much the resilience of the sample F (sample a) is changed with time (deteriorated by heat, ultraviolet rays, humidity or fatigue due to repeated stress). This determination is preferably made in such manners that the resilience after the change with time satisfies any one of Equations 1, 2 and 3 and that variations in the material properties and in process conditions are taken into consideration. For example, in the case of the sample F (sample a), suppose that the resilience decreases by 30% due to the change with time and the physical property values decrease by 30% due to the variation in the initial material physical properties, and the film thickness varies by 20% because of the variation in process conditions (manufacture), for example, the film thickness at the initial design is obtained as high-W: Min. 90 μm and low-W: Min. 80 μm from the conditions of high-W: Min. 35 μm and low-W: Min. 30 μm.

<Evaluation of Reliability and Life Expectancy of Shatter Protective Film>

Then, in order to examine how a shatter protective film (silicone thin film) for an electrodeless self-ballasted fluorescent lamp maintains its function of preventing shattering of the glass in relation to ambient (usage) environments, the present inventors predicted a change (change in the physical property values) with time of a material for a shatter protective film, to examine the function of the shatter protective film through an accelerated life test.

An electrodeless self-ballasted fluorescent lamp has a rated life of 20,000 hours, which is about 3 times as long as a self-ballasted fluorescent lamp with electrodes. However, all the lamps are not inoperable after 20,000 hours as rated and it can be easily estimated that some of the lamps are still operable after 25,000 to 30,000 hours. The shatter protective film needs to maintain the function of preventing shattering of the glass all the time from the fabrication of the lamp through transfer for shipment and the operation period to disposal at the end of the lamp life.

However, in actuality, it is difficult to conduct a process of performing a life test under actual service conditions for 30,000 hours, to determine whether or not the function is maintained and then giving a feedback to the strength design. To conduct this process, the change (deterioration) with time needs to be promoted (accelerated) at a faster speed than usual to replicate a failure in the same mode within a short time for confirmation. If the test is performed without grasping the mechanism of the failure, not the acceleration test but merely a destructive test is achieved. Therefore, the present inventors conducted the test with full consideration.

The accelerated life test and an expected failure mode will be hereinafter described. In a test under a constant stress (for distribution of failure periods) performed as the accelerated life test, the sample is expected to be left at high temperatures or at high temperatures and high humidities, or exposed to ultraviolet rays. In the case of a cyclic test (for influence of repeated stresses), a heat-shock is expected to be applied. The possible failure modes can be (I) degradation in performance and discoloration, for example, due to deterioration (by heat and ultraviolet rays) and (II) incapability of exhibiting its performance, e.g., denaturation/alternation due to peeling-off of the film, failure in the formation (bubbles, uncoated or deviation from design), and a reaction with another material.

With respect to the deterioration in (I), there provided a "stoichiometric model" in which a reaction between solid-state molecules affected by heat or ultraviolet rays and a "stress-strength model" showing deterioration from repeated stress such as the heat-shock test. The test was also performed on the shatter protective film to examine its performance at the end stage of the life.

Change in Heat-Resistance Physical Properties

Figure 11:
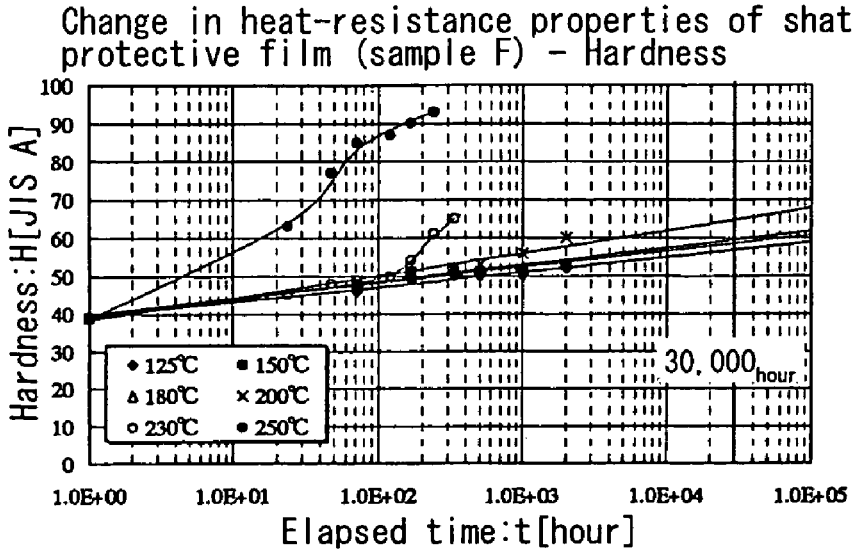
FIGS. 11(*a*) through 11(*c*) are graphs showing changes per hour in hardness, tensile strength and elongation at break, respectively.
Figure 11:
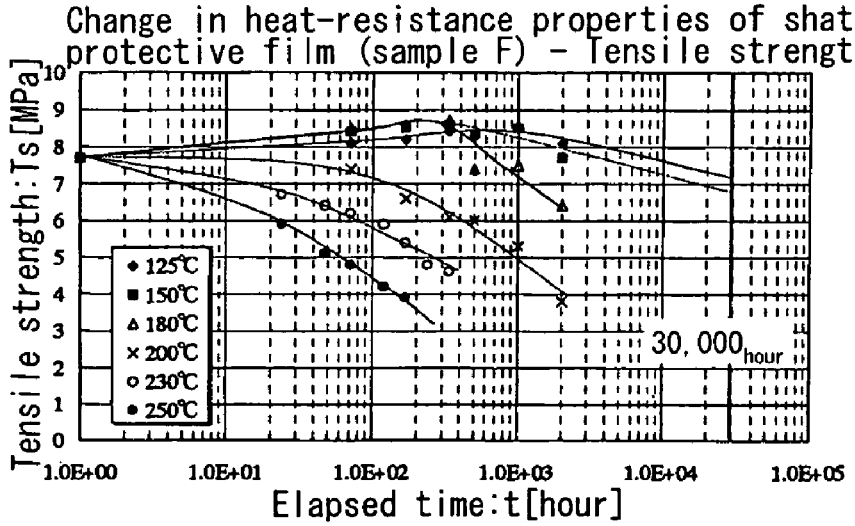
Figure 11:
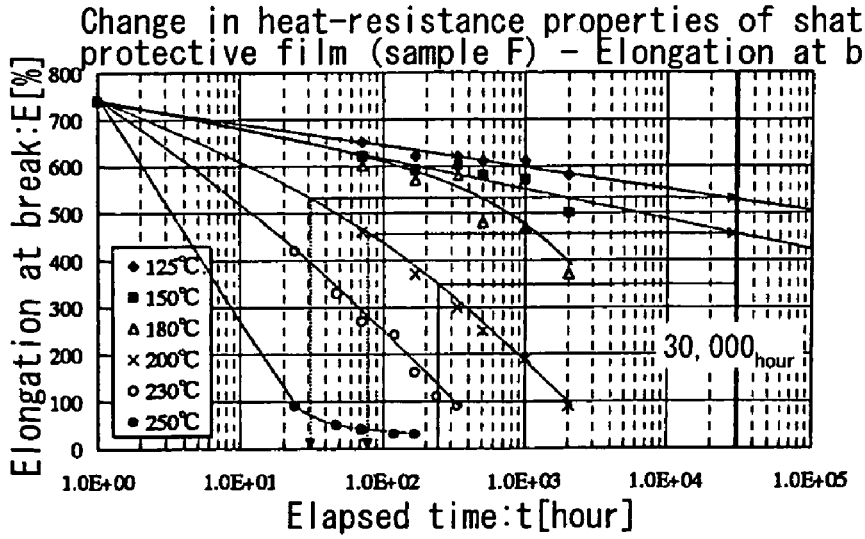

It was determined whether or not the function is maintained by measuring the change in the heat-resistance physical properties of the silicone rubber used for the shatter protective film and simulating a "fracture" of the luminous bulb after 30,000 hours. FIGS. 11(*a*) through 11(*c*) show changes in the heat-resistance properties of the sample F (sample a) used for the shatter protective film. FIGS. 11(*a*) through 11(*c*) are graphs on the hardness, the tensile strength and the elongation at break, respectively. The expression of "1.0E+X" means the x-th power of 1.0×10. For example, 1.0E+2 represents $10.0\times10^2$.

Figure 12:
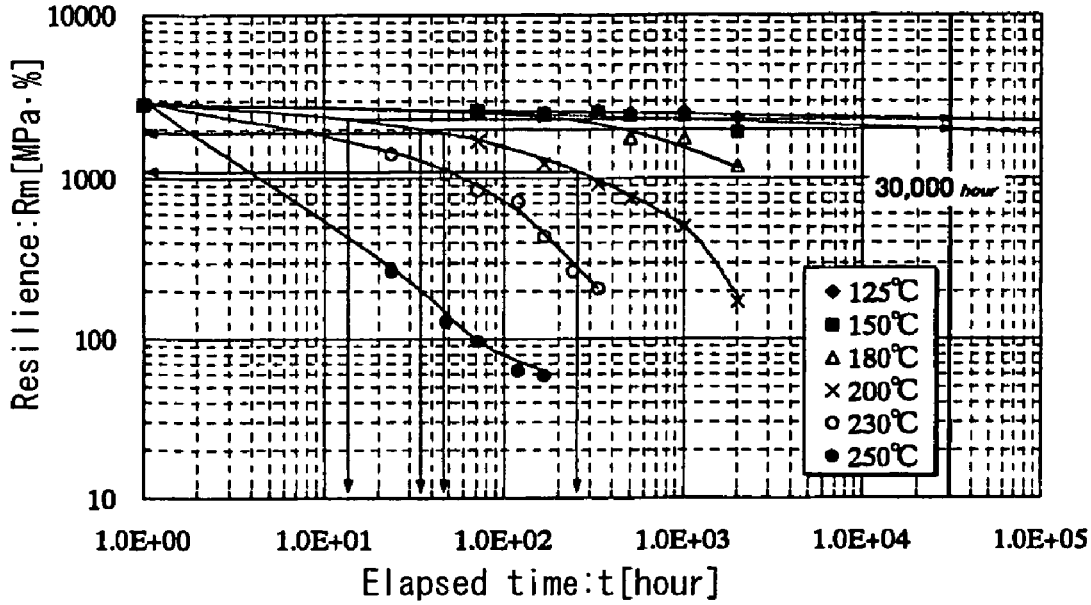
FIG. 12 is a graph showing a change per hour in resilience.

The change in the resilience per hour can be calculated from the physical property values of the tensile strength and the elongation at break by definition. FIG. 12 shows a change in the resilience per hour based on the change per hour in the tensile strength and the elongation at break of the sample F (sample a) (FIG. 11). The maximum temperature that the luminous bulb has reached is 125 to 130° C. for the high-W and 90 to 100° C. for the low-W. Accordingly, the life expectancy characteristic under 125° C. is preferably referred to. In the case of temperature of 90 to 100° C., the deterioration is suppressed to some degree. The reason why the changes in the heat-resistance physical properties under 230° C. and 250° C. differ apparently from those under 125° C. to 200° C. in FIG. 11 is the occurrence of thermal decomposition.

The maximum temperature that the high-W luminous bulb in the electrodeless self-ballasted fluorescent lamp reaches is approximately 125° C. to 130° C. around the neck portion. The test was performed under the conditions of a system input voltage of 110 V, an ambient temperature of 30 to 40° C., being operated in an aluminum downlight luminaire with an aperture of 100 mmø (produced by Matsushita Electric Works, Ltd. "Incandescent Lamp Luminaire, Product No. NL70153T-R50"). This luminaire requires the most rigid temperature conditions among the luminaries on the market. In view of this, the change in the physical properties of the sample F (sample a) under 125° C. after 30,000 hours is predicted.

In estimating the life of a rubber elastomer, the Arrhenius plot is generally applicable to the elongation at break and the hardness. The Arrhenius plot is considered to be also applicable to the tensile strength in the range from 125° C. to 150° C. because the variation is small in this range. However, the tensile strength was fit with its value underestimated in consideration of the decrease in actual measured value after 2,000 hours. FIG. 24 shows predicted physical property values of the sample F (sample a) after 30,000 hours based on the above data.

The variation in the physical property values after 30,000 hours under temperature conditions of a maximum temperature of 125° C. conceivable under actual service conditions (the physical property values under 130° C. is considered to hardly differ from those under 125° C.) is almost the same as that under conditions of 200° C./48 h. With the assumption that a margin of approximately 40% is provided in consideration of variation in the physical properties of the material on a product basis, i.e., in consideration of the minimum values of the respective physical properties, this variation is the same as in a case where the physical properties are changed under conditions of 200° C./240 h.

Accordingly, in the actual design regarding the film thickness, if the sample subjected to exposure under conditions of 200° C./240 h passes both the "3 m drop test" and the "heat-shock forced destructive test on the sealing portion", the sample has no problems in terms of thermal degradation. FIGS. 25 and 26 show results of the destructive test.

FIGS. 25 and 26 show results of a 3 m-drop test after a heat-resistance accelerated test on the low-W and the high-W, respectively. As is clear from these results, in the drop test, the maximum shattering distance (radius) of glass fragments is within 50 cm even after degradation of the shattering preventing film material with time under conditions of 125° C./30,000 hours. Even if a margin of 40% for variation in the physical properties of the material is taken, the maximum shattering distance (radius) is within 50 cm.

Figure 13:
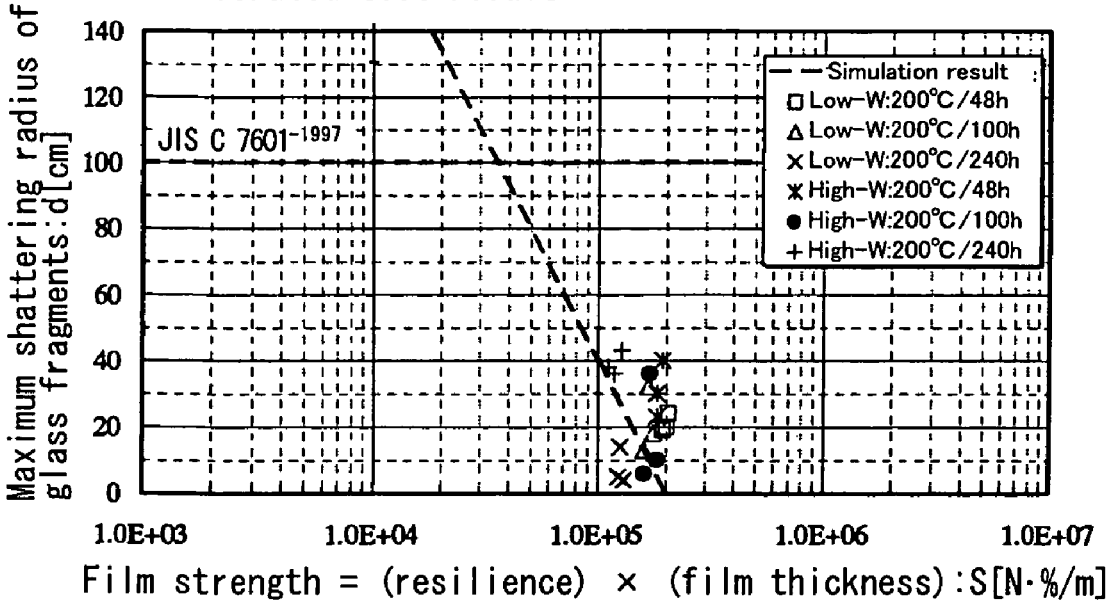
FIG. 13 is a graph for comparison between simulation results and accelerated test results.

As shown in FIG. 13, if the results obtained from FIGS. 25 and 26 are plotted on a graph of a relationship between the physical property values of the film material obtained through simulations and the maximum shattering distance of glass fragments, the result of the experiments is almost replicated. Accordingly, the results of the simulations based on the Equation 1 are verified.

<Heat-Shock Forced Destructive Test on Sealing Portion After Test of Life Expectancy Under Heated Conditions>

Now, results of a heat-shock forced destructive test performed on a sealing portion after a test of the life expectancy under heated conditions will be described. FIGS. 27 and 28 show results of a heat-shock forced destructive test on a sealing portion after a test of the life expectancy under heated conditions.

Figure 14:
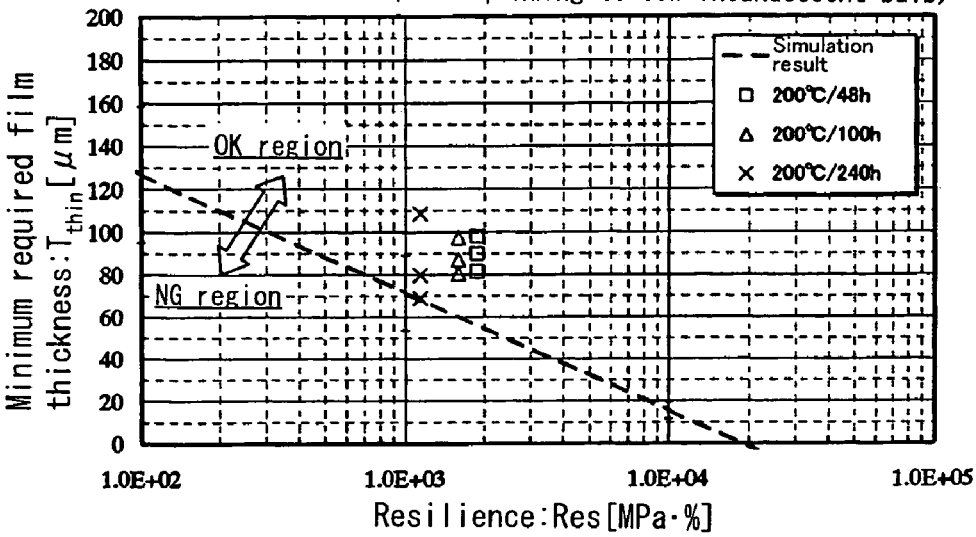
FIGS. 14(*a*) and 14(*b*) are graphs for comparison between simulation results and accelerated test results with a low-W luminous bulb and a high-W luminous bulb, respectively.
Figure 14:
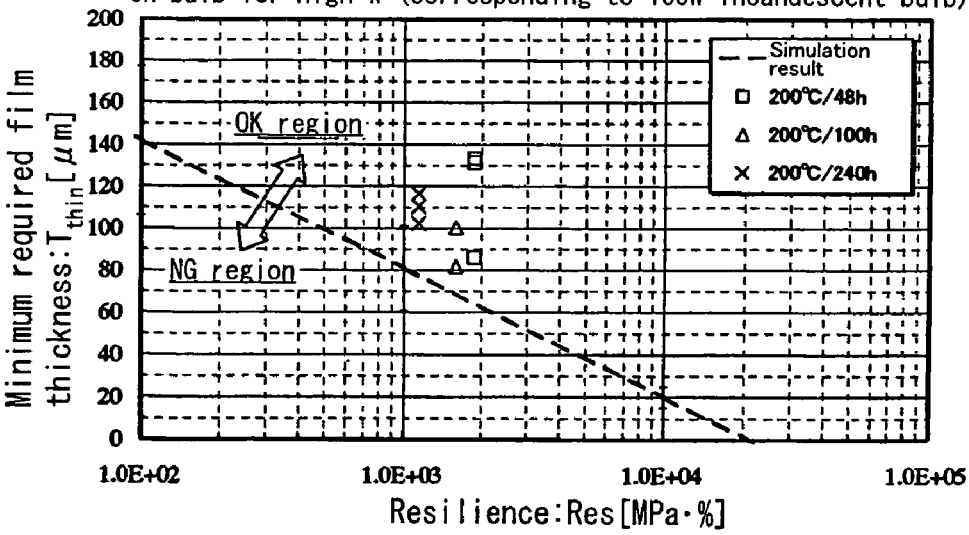

From FIGS. 27 and 28, it is understood that the shattering of glass fragments can be still suppressed after degradation of heat-resistance with time under conditions of 125° C./30,000 hours for each of the high-W and the low-W. FIGS. 14(*a*) and 14(*b*) show respective variations in the physical property values after heat-resistance degradation with time plotted on the physical property value threshold curve of the film material obtained through simulations.

As shown in FIG. 14, since all the results shown in FIGS. 27 and 28 plotted in the "OK" region are "PASS", the validity of the simulations using the Equations 2 and 3 is proved. This implies that no problems were found in an accelerated test of the life expectancy under heated conditions and thus the sample can withstand the environment of 125° C./30,000 hours.

The change in the physical properties caused by ultraviolet rays was further examined through experiments, and no problems were found for practical applications. A cycle heat-shock test of repeating the procedure of leaving the sample at 150° C. for 30 min., leaving at room temperature for 30 min. and then leaving at 20° C. for 30 min 1000 times (1000 cycles) was also conducted, and no problems were also found for practical applications.

Figure 15:
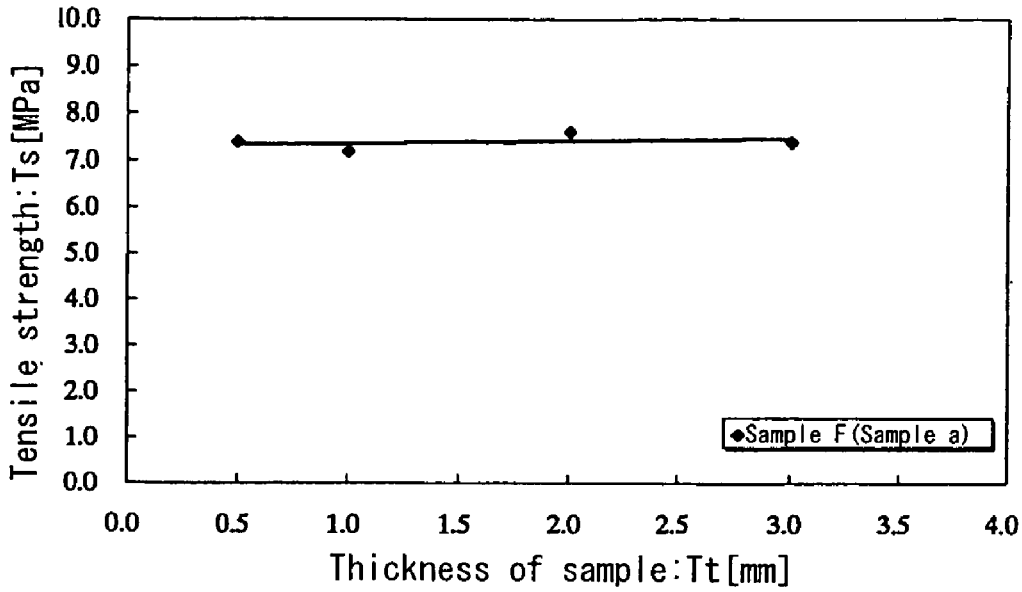
FIG. 15 is a graph showing a sample-thickness dependence of the tensile strength.
Figure 16:
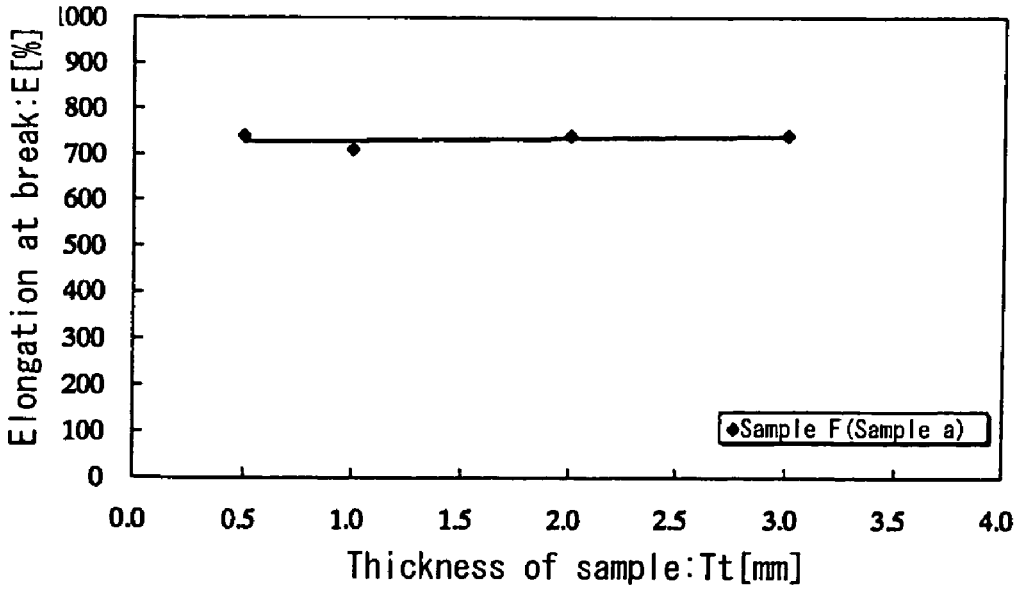
FIG. 16 is a graph showing a sample-thickness dependence of elongation at break.

The tensile strength and the elongation at break were measured based on the mechanics test method for rubber in JIS K 6249. However, since the tensile strength and the elongation at break are less dependent on the thickness as long as the sample is used for a shatter protective film, the tensile strength and the elongation at break are not necessarily measured by this method and may be measured using a thin film. The sample-thickness dependences of the tensile strength and the elongation at break are shown in FIGS. 15 and 16.

In the electrodeless self-ballasted fluorescent lamp of this embodiment, at least the surface of the upper hemisphere of the outer tube 12 of the luminous bulb 1 is coated with the silicone rubber 10 having the property of transmitting light. Accordingly, if the lamp shatters, it is possible to effectively prevent the shattering.

If the luminous bulb 1 is for a high-W, $T_{thin} \geqq -26.453\mathrm{Ln}(\mathrm{Res})+263.54$ is preferably satisfied. If the luminous bulb 1 is for a low-W, $T_{thin} \geqq -24.232\mathrm{Ln}(\mathrm{Res})+238.53$ is preferably satisfied. Regardless of whether the luminous bulb 1 is for the high-W or the low-W, $-58.271\mathrm{Ln}(T_{ave}\cdot\mathrm{Res})+711.03<100$ is preferably satisfied, and $-58.271\mathrm{Ln}(T_{ave}\cdot\mathrm{Res})+711.03<75$ is more preferably satisfied. In such cases, substantially the entire outer surface of the outer tube 12 is preferably coated with the silicone rubber 10.

Figure 17:
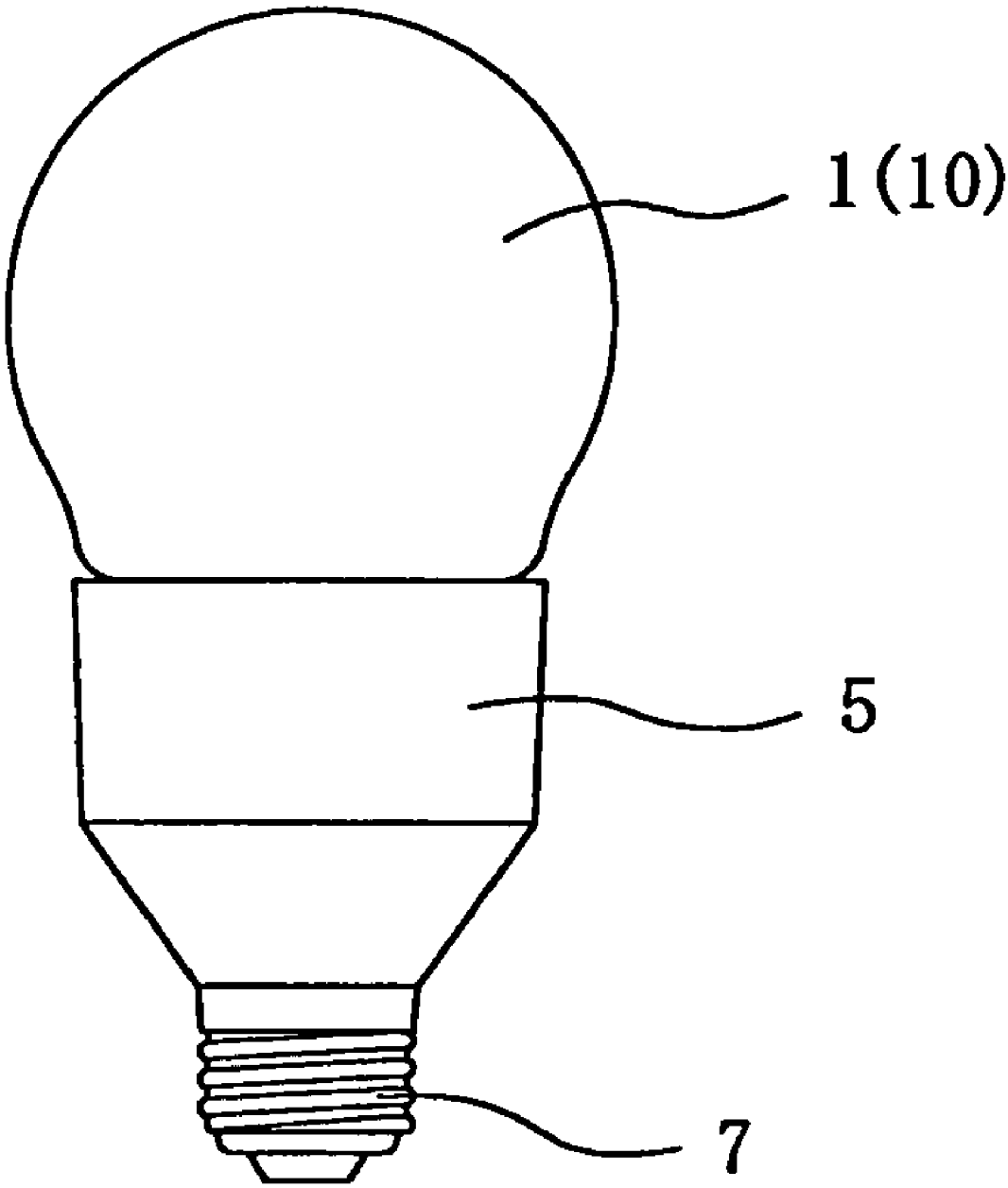
FIG. 17 is a view illustrating an outward appearance of the electrodeless self-ballasted fluorescent lamp of the first embodiment.

The outward appearance of the electrodeless self-ballasted fluorescent lamp of this embodiment is shown in FIG. 17 in both cases of the high-W and the low-W. In the case of the high-W, the luminous bulb 1 has a maximum outside diameter of 65 to 90 mm, a glass thickness of 0.8 to 2.0 mm and an average grass thickness at the upper hemisphere of 1.0±0.2 mm. In the case of the low-W, the luminous bulb 1 has a maximum outside diameter of 60 to 80 mm, a glass thickness of 0.8 to 2.0 mm and an average grass thickness at the upper hemisphere of 1.3±0.2 mm. Since the luminous bulb 1 is approximately spherical in both cases, the difference in minimum required film thickness between the cases of the high-W and the low-W corresponds to the difference in glass thickness.

Figure 18:
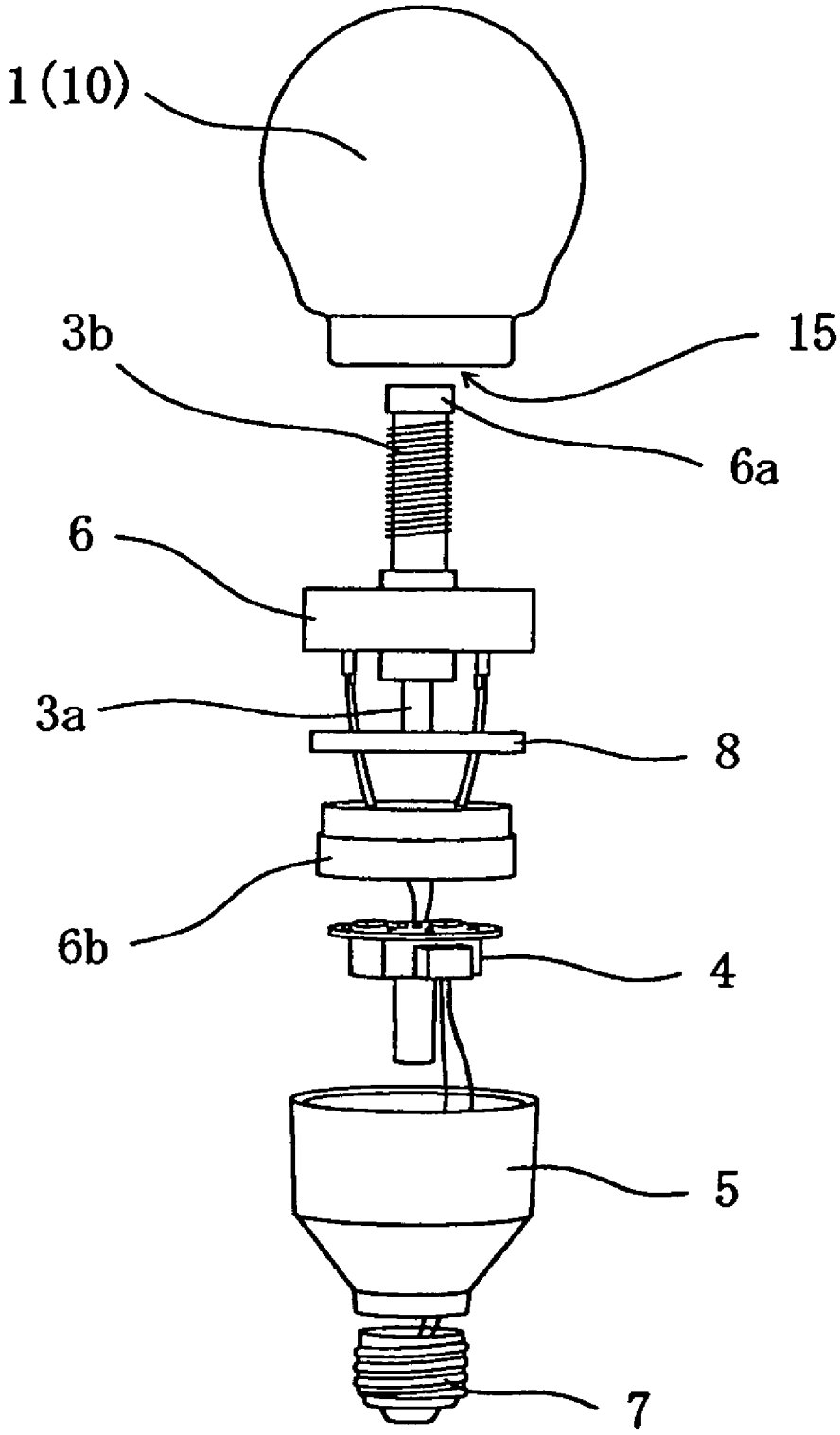
FIG. 18 is an exploded view of the electrodeless self-ballasted fluorescent lamp.

FIG. 18 shows respective components in a case where the electrodeless self-ballasted fluorescent lamp shown in FIG. 17 is taken apart. In this example, the holder 6 also serves as a bobbin (6*a*) for the coil 3*b*, and the core 3*a* is placed inside the tube that forms the bobbin 3*b*. At an end of the core 3*a*, a heat sink 8 for dissipating heat is provided. The heat sink 8 and a ballast holder 6*b* can be housed and fixed in the holder 6. As described with respect to the configuration shown in FIG. 1, the luminous bulb 1 can be fixed to the cover 8 with the holder 6.

(Embodiment 2)

The electrodeless self-ballasted fluorescent lamp of the first embodiment may be modified as follows.

First, since a coating of silicone rubber is sticky as a characteristic of rubber and thus is liable to get dirty, a thin film in which a material having a photocatalytic function such as titanium dioxide ($TiO_2$) is mixed may be provided in the shatter protective film 10 to produce the effects of preventing soiling, sterilization and others. Alternatively, to remove the stickiness of rubber, a thin film made of polymeric resin may be formed as the uppermost layer to make the surface non-sticky. Then, the coating is not liable to get dirty and the soil can be easily taken off.

Alternatively, the shatter protective film 10 may be coated with a thin film having a color-filtering function to be a multilayer film. Then, it is possible to change the color of the light emission into colors which cannot be obtained by adjustment with the luminophor. In addition, to prevent emission of harmful ultraviolet rays, a thin film having the function of absorbing ultraviolet rays may be formed over the shatter protective film 10. These thin films may be interposed between the outer surface of the luminous bulb and the shatter protective film 10.

In the embodiment of the present invention, the luminescent layer 2 is formed on at least part of the inner surface of the luminous bulb 1. This luminescent layer 2 may be formed only on the outer tube 12 or may be formed on the surfaces of both the outer tube 12 and the inner tube 11. The luminescent layer may also be formed on the shatter protective film 10 or between the shatter protective film 10 and the outer surface of the luminous bulb 1. Furthermore, a luminophor may be mixed in the silicone rubber constituting the shatter protective film 10. Then, an electrodeless self-ballasted fluorescent lamp which allows the luminophor to emit light even after turning-off of the lamp is implemented. Such a lamp is applicable to emergency lighting, for example.

Figure 19:
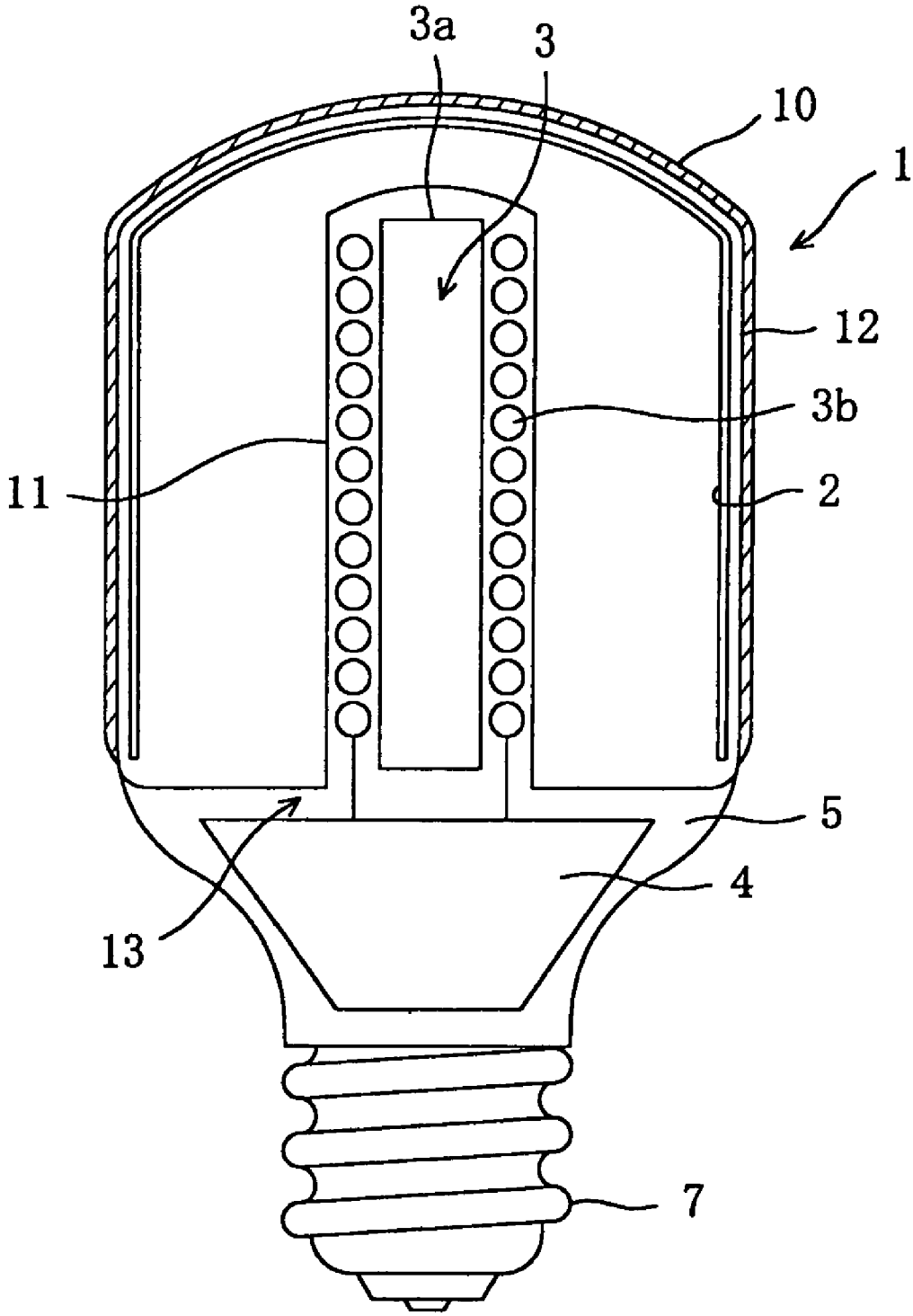
FIG. 19 is a cross-sectional view schematically showing an example of an electrodeless self-ballasted fluorescent lamp according to a second embodiment of the present invention.
Figure 20:
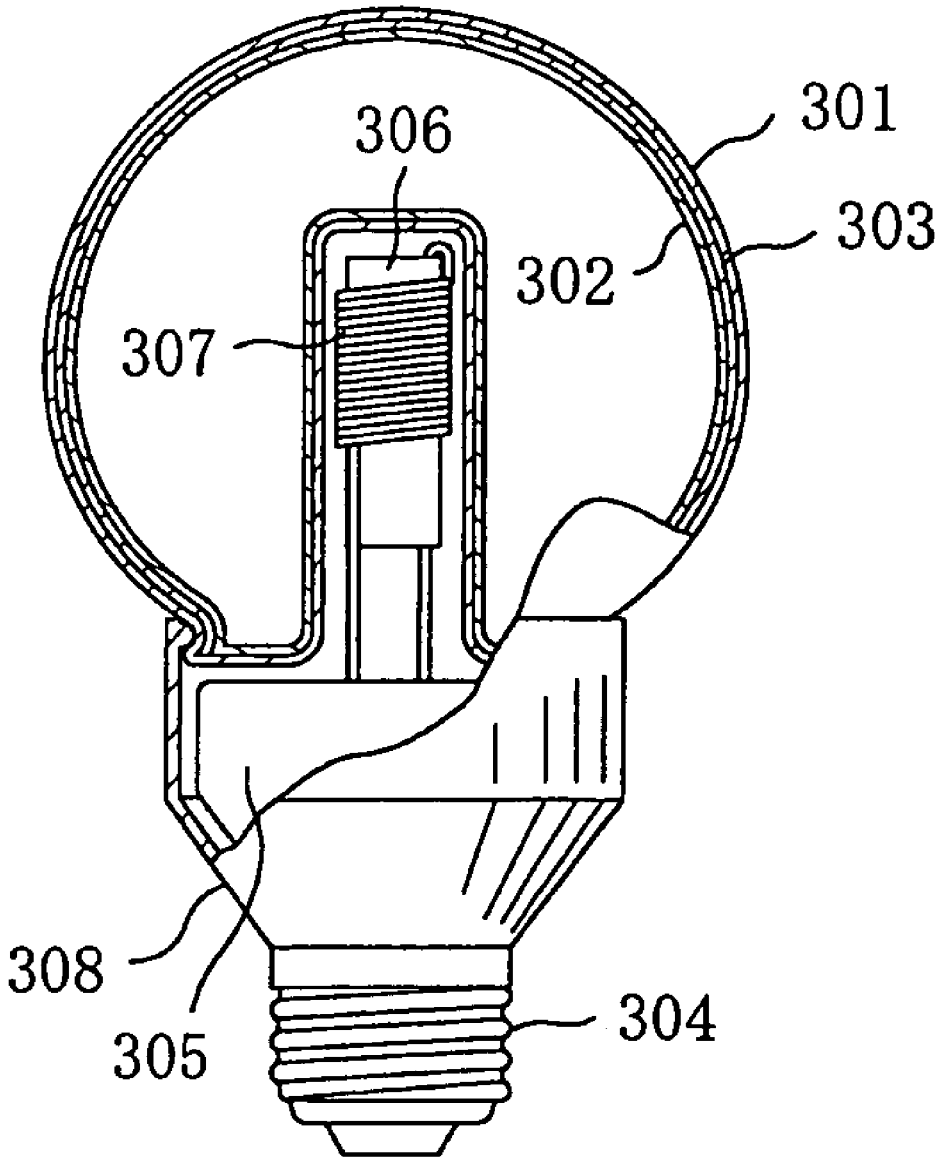
FIG. 20 is a cross-sectional view schematically showing a configuration of a conventional electrodeless self-ballasted fluorescent lamp.
Figure 21:
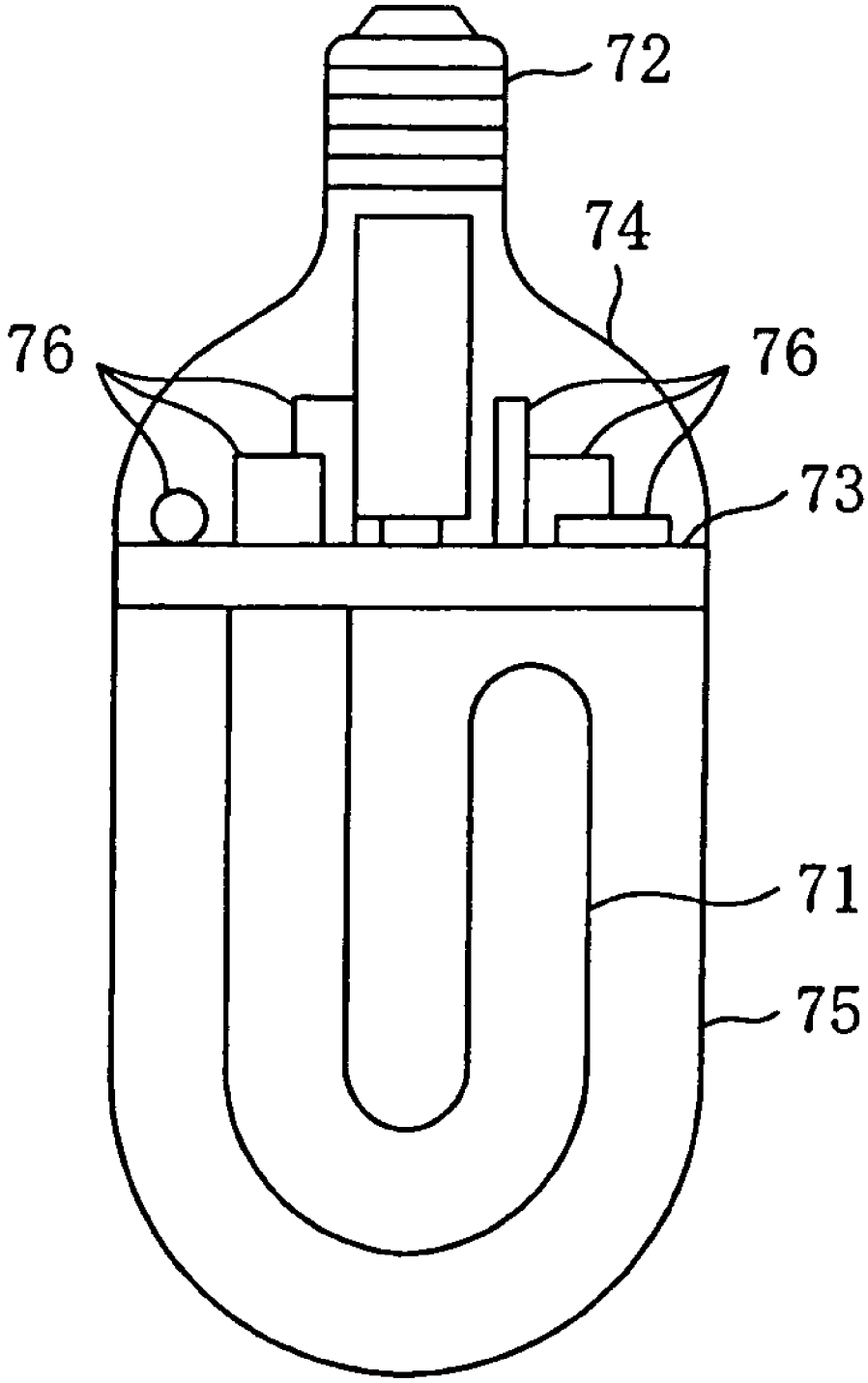
FIG. 21 is a cross-sectional view schematically showing a configuration of a conventional self-ballasted fluorescent lamp with electrodes.

The luminous bulb 1 may not be perfectly spherical but may be configured as shown in FIG. 19 as long as the luminous bulb 1 is approximately spherical. Now, the frequency of the high-frequency voltage applied from the ballast 4 to the luminous bulb 1 will be described. The frequency used in this embodiment of the present invention is in a relatively low range less than or equal to 1 MHz (e.g., from 40 to 500 kHz), i.e., which is lower than the ISM frequency band of 13.56 MHz or several MHz generally used in practical applications. The reason why the frequency in this low-frequency range is used is as follows: First, in a case where the lamp is operated in the relatively-high frequency range of 13.56 MHz or several MHz, a large noise filter for suppressing line noise generated from a high-frequency power supply circuit in the ballast (circuit board) is required, so that the high-frequency power supply circuit needs to be also large in volume. If high-frequency noise is produced or propagated from the lamp, the use of an expensive shield is required to meet the requirement of strict regulation provided on the high-frequency noise by laws, and this is an obstacle to cost reduction. On the other hand, in a case where the lamp is operated in the frequency range from 40 kHz to 1 MHz, a cheap general-purpose product which is used as an electronic component for general electronic equipment can be used as a component of the high-frequency power supply circuit as well as a small component can be used, so that cost reduction and miniaturization can be advantageously achieved. The configuration of this embodiment is not limited to operation at frequencies of 1 MHz or less and is also applicable to operation at frequencies such as 13.56 MHz and several MHz.

A silicone rubber in which an aromatic functional group has been introduced may be used as the silicone rubber constituting the shatter protective film 10. This is because such a silicone rubber can absorb visible light in the blue range. With this configuration, even in a case where the vapor pressure of enclosed mercury increases to produce mercury emission lines in the blue range as the temperature of the luminous bulb in operation inside the luminaire increases so that the color temperature shits to higher levels, the emitted light in the blue range is absorbed in the silicone rubber, resulting in correction of the color temperature shift.

In addition, a whitened silicone rubber in which a white powder is mixed may be used as the silicone rubber constituting the shatter protective film 10 as long as the above relationships between the resilience value and the silicone rubber thickness are satisfied. Then, even if the luminescent layer 2 is partly peeled off by a shock such as vibration, it is possible to conceal the peeling outwardly and the production yield is enhanced, and unevenness of coating is also inconspicuous.

Further, a silicone rubber in which a metal powder is mixed may be used as the silicone rubber constituting the shatter protective film 10 as long as the above relationships between the resilience value and the silicone rubber thickness are satisfied. For example, if a trace amount of powder of metal such as aluminum, copper and silver is mixed in the silicone rubber, the electromagnetic shielding effect of suppressing, for example, radiation noise produced from the electrodeless self-ballasted fluorescent lamp can be obtained. Metals whose properties deteriorate when oxidized are preferably subjected to a process for preventing oxidation. It should be noted that mixing a powder such as a white powder or a metal powder has many drawbacks such as decrease in the strength of the silicone rubber film, agglomeration of particles which leads to film unevenness at the coating, and difficulty in management in storing a coating solution in which the powder is mixed. Therefore, the coating solution is preferably made of polymeric materials only. Accordingly, the shatter protective film 10 is preferably made of only polymeric materials.

In the embodiments of the present invention, the configurations of the electrodeless self-ballasted fluorescent lamp are described. The electrodeless self-ballasted fluorescent lamp may be configured without the luminophor. In other words, the lamp may be a discharge lamp in which no luminophor is applied onto a discharge bulb such as a bactericidal lamp. Moreover, the lamp is not limited to applications to general lighting and may be used to operate sunlamps having action spectra effective at, for example, erythemal radiation and production of vitamin D or lamps for plant rearing having action spectra effective at photosynthesis and morphogenesis of plants. Furthermore, since the object of the present invention is preventing shattering of the luminous bulb 1, the configuration of the embodiments of the present invention is not limited to bulbs and may be applied to a discharge lamp operating apparatus (electrodeless discharge lamp operating apparatus) in which the luminous bulb 1 and the ballast 4 are provided separately.

According to the present invention, at least the surface of the upper hemisphere of the outer tube constituting the luminous bulb is coated with a silicone rubber having the property of transmitting light and satisfying a given relationship between the resilience value and the film thickness. Accordingly, even if the lamp shatters, the shattering is prevented effectively.

INDUSTRIAL APPLICABILITY

According to the present invention, even if the luminous bulb is broken by a drop or a heat shock, shattering of the fragments can be effectively prevented. Accordingly, the present invention has a high industrial applicability in application of a safe electrodeless self-ballasted fluorescent lamp and a safe electrodeless discharge lamp operating apparatus.

The invention claimed is:

1. An electrodeless self-ballasted fluorescent lamp, comprising:

a luminous bulb in which a luminous gas is enclosed and which has a cavity portion;

an induction coil inserted in the cavity portion;

a ballast electrically connected to the induction coil; and a base electrically connected to the ballast, wherein the luminous bulb, the ballast and the base are configured as one unit, the luminous bulb includes an approximately spherical outer tube and an inner tube defining the cavity portion, the luminous bulb is made of glass, at least the surface of an upper hemisphere of the outer tube is coated with a silicone rubber having the property of transmitting light, the silicone rubber directly on the surface of the outer tube, and the following relationship is satisfied:

$$-58.271Ln(T_{ave}\cdot\mathrm{Res})+711.03<100$$

Ln represents a natural logarithm where Res is a resilience value [MPa·%] defined by multiplying 0.5 by a value equal to the tensile strength [MPa] of silicone rubber, and a value equal to the elongation at break [%] of silicone rubber, and $T_{ave}$ is an average film thickness [μm] of the silicone rubber; and wherein the silicone rubber is a silicone rubber in which an aromatic functional group has been introduced to absorb visible light in the blue range.

2. The electrodeless self-ballasted fluorescent lamp of claim 1, wherein the following relationship is satisfied:

$$-58.271Ln(T_{ave}\cdot\mathrm{Res})+711.03<75.$$

3. An electrodeless self-ballasted fluorescent lamp, comprising:

a luminous bulb in which a luminous gas is enclosed and which has a cavity portion;

an induction coil inserted in the cavity portion;

a ballast electrically connected to the induction coil; and a base electrically connected to the ballast, wherein the luminous bulb, the ballast and the base are configured as one unit, the luminous bulb includes an approximately spherical outer tube and an inner tube defining the cavity portion and is for a lamp of high wattage having a rated luminous flux corresponding to a 100 W incandescent bulb, the luminous bulb is made of glass, at least the surface of an upper hemisphere of the outer tube is coated with a silicone rubber having the property of transmitting light, the silicone rubber directly on the surface of the outer tube, and the following relationship is satisfied:

$$T_{thin} \geqq -26.453 Ln(\text{Res}) + 263.54$$

Ln represents a natural logarithm where Res is a resilience value [MPa·%] defined by multiplying 0.5 by a value equal to the tensile strength [MPa] of silicone rubber, and a value equal to the elongation at break [%]of silicone rubber, and $T_{thin}$ is a minimum required film thickness [μm] of the silicone rubber; and wherein the silicone rubber is a silicone rubber in which an aromatic functional group has been introduced to absorb visible light in the blue range.

4. An electrodeless self-ballasted fluorescent lamp, comprising:

a luminous bulb in which a luminous gas is enclosed and which has a cavity portion;

an induction coil inserted in the cavity portion;

a ballast electrically connected to the induction coil;

a base electrically connected to the ballast, wherein the luminous bulb, the ballast and the base are configured as one unit, the luminous bulb includes an approximately spherical outer tube and an inner tube defining the cavity portion and is for a lamp of low wattage having a rated luminous flux corresponding to a 60 W incandescent bulb, the luminous bulb is made of glass, at least the surface of an upper hemisphere of the outer tube is coated with a silicone rubber having the property of transmitting light, the silicone rubber directly on the surface of the outer tube, and the following relationship is satisfied:

$$T_{thin} \geqq -24.232 Ln(\text{Res}) + 238.53$$

Ln represents a natural logarithm where Res is a resilience value [MPa %] defined by multiplying 0.5 by a value equal to the tensile strength [MPa] of silicone rubber, and a value equal to the elongation at break [%] of silicone rubber, and $T_{thin}$ is a minimum required film thickness [μm] of the silicone rubber; and wherein the silicone rubber is a silicone rubber in which an aromatic functional group has been introduced to absorb visible light in the blue range.

5. The electrodeless self-ballasted fluorescent lamp of any one of claims 1 to 4, wherein substantially an entire surface of the outer tube is coated with the silicone rubber.

6. The electrodeless self-ballasted fluorescent lamp of any one of claims 1 to 4, wherein a thin film having a color-filtering function is formed over the coating of the silicone rubber or between the coating of the silicone rubber and a surface of the outer tube.

7. The electrodeless self-ballasted fluorescent lamp of any one of claims 1 to 4, wherein a thin film having the function of absorbing ultraviolet rays is formed over the coating of the silicone rubber or between the coating of the silicone rubber and the surface of the outer tube.

8. The electrodeless self-ballasted fluorescent lamp of any one of claims 1 to 4, wherein a thin film having a photocatalytic function is formed over the coating of the silicone rubber.

9. The electrodeless self-ballasted fluorescent lamp of any one of claims 1 to 4, wherein a thin film made of a polymeric resin is formed over the coating of the silicone rubber.

10. An electrodeless discharge lamp operating apparatus, comprising a luminous bulb having a cavity portion, wherein a shatter protective film made of a silicon rubber is formed over an outer surface of the luminous bulb; and wherein the silicone rubber is a silicone rubber in which an aromatic functional group has been introduced to absorb visible light in the blue range.

11. The electrodeless discharge lamp operating apparatus of claim 10, wherein a luminescent layer is formed on at least part of an inner surface of the luminous bulb.

12. The electrodeless discharge lamp operating apparatus of claim 10 or 11, wherein a luminescent layer is formed on the shatter protective film or between the shatter protective film and the outer surface of the luminous bulb.

13. The electrodeless discharge lamp operating apparatus of claim 10 or 11, wherein the silicone rubber is a silicone rubber in which a luminophor is mixed.

* * * * *

UNITED STATES PATENT AND TRADEMARK OFFICE

CERTIFICATE OF CORRECTION

PATENT NO. : 7,215,082 B2
APPLICATION NO. : 10/490924
DATED : May 8, 2007
INVENTOR(S) : Takeshi Arakawa et al.

It is certified that error appears in the above-identified patent and that said Letters Patent is hereby corrected as shown below:

COLUMN 20

Line 5, Claim 4, "[MPa%]" should be -- [MPa•%] --

Line 15, Claim 5, "1 to 4" should be -- 1 to 3 --

Line 18, Claim 6, "1 to 4" should be -- 1 to 3 --

Line 23, Claim 7, "1 to 4" should be -- 1 to 3 --

Line 28, Claim 8, "1 to 4" should be -- 1 to 3 --

Line 32, Claim 9, "1 to 4" should be -- 1 to 3 --

Signed and Sealed this

Twenty-fourth Day of July, 2007

JON W. DUDAS
*Director of the United States Patent and Trademark Office*